US012751555B2

(12) United States Patent
Aubé et al.

(10) Patent No.: US 12,751,555 B2
(45) Date of Patent: Oct. 6, 2026

(54) MODULAR SEATING ASSEMBLY AND METHOD OF ASSEMBLY THEREOF

(71) Applicant: COZEY INC., Mont-Royal (CA)

(72) Inventors: Frédéric Aubé, Mont-Royal (CA); Marjorie Lebreux, Mont-Royal (CA)

(73) Assignee: COZEY, INC., Mont-Royal (CA)

( * ) Notice: Subject to any disclaimer, the term of this patent is extended or adjusted under 35 U.S.C. 154(b) by 147 days.

(21) Appl. No.: 18/619,115

(22) Filed: Mar. 27, 2024

(65) Prior Publication Data

US 2024/0341486 A1 Oct. 17, 2024

Related U.S. Application Data

(60) Provisional application No. 63/492,339, filed on Mar. 27, 2023.

(51) Int. Cl.

| | |
|---|---|
| ***A47C 13/00*** | (2006.01) |
| ***A47C 4/02*** | (2006.01) |
| ***A47C 15/00*** | (2006.01) |

(52) U.S. Cl.

CPC ..... *A47C 13/005* (2013.01); *A47C 4/021* (2013.01); *A47C 15/002* (2013.01)

(58) Field of Classification Search

CPC ..... A47C 13/00; A47C 13/005; A47C 4/021; A47C 15/002

See application file for complete search history.

(56) References Cited

U.S. PATENT DOCUMENTS

| | | | | |
|---|---|---|---|---|
| 11,464,339 | B2 * | 10/2022 | Milberg | A47C 4/021 |
| 2020/0268160 | A1 * | 8/2020 | Kuhl | A47C 17/86 |
| 2024/0415290 | A1 * | 12/2024 | Aubé | A47C 13/005 |

* cited by examiner

*Primary Examiner* — Justin Michael Heston

(74) *Attorney, Agent, or Firm* — FULLER IP LAW LLC; Rodney J. Fuller

(57) ABSTRACT

There is provided a modular seating assembly that includes a plurality of modules that, when assembled, can form multiple types of indoor or outdoor seating arrangements, such as an ottoman, a chair, a loveseat, a 3-, 4-, or 5-seater sofa, a 3-, 4-, or 5-seater corner sofa or sectional, an end sofa, etc. The end modules, which may or may not include an armrest portion, the leg modules, and the backrest modules can include flanges and/or brackets that are configured to be inserted in an opening of an adjacent seat module. Accordingly, two adjacent end or leg modules can be supported by a surface, such as the ground, a floor or a patio, and the seat module can be placed on top of the leg portions in a manner that the flanges are inserted into the openings, allowing the seating arrangement to be assembled in an upright position.

20 Claims, 33 Drawing Sheets

MODULAR SEATING ASSEMBLY AND METHOD OF ASSEMBLY THEREOF

CROSS-REFERENCE

This application claims the benefit of U.S. Provisional Patent Application No. 63/492,339, filed on Mar. 27, 2023, which is hereby incorporated by reference in its entirety.

TECHNICAL FIELD

The technical field generally relates to a modular furniture assembly, and methods of assembling the modular furniture assembly. Specifically, the technical field relates to modular seating assemblies that can be arranged in multiple different seating arrangements, and methods of assembly thereof.

BACKGROUND

Conventional seating furniture are typically manufactured as a single frame either covered with padding and fabric and/or provided with cushions. The frame and cushions are then transported directly to the consumer, or to a retail outlet. The bulky nature of the furniture items can result in significant transport and storage costs. Modular furniture, which is made of individual pieces that can be coupled together in different configurations, can reduce both transportation and storage costs, as the frame modules, when disassembled, can be transported or stored in a smaller space per furniture item.

Conventional modular furniture are often assembled and secured to adjacent modules in a piecemeal fashion. In other words, adjacent modules are coupled to each other one at a time with fasteners, until the last module is added to form the piece of furniture. Typically, the last module to be attached is the legs or feet, which requires flipping the piece of furniture on its fabric-covered side or back to attach the legs or feet. This can cause the fabric to be soiled, or otherwise get dirty prior to being used, especially when the modular furniture is intended for outdoor use.

Other conventional modular furniture include adjacent modules that are attached to each other via fasteners, such as screws or bolts. Once assembled, these conventional modular furniture often show these fasteners on one or more sides of the furniture, such as a screw or bolt head on the front, sides, or back of the furniture, which is not esthetically pleasing.

In view of the above, there is a need for more cost effective and efficient assemblies that would be able to overcome or at least minimize some of the above mentioned prior art concerns.

SUMMARY

According to some aspects, there is provided a modular seating assembly comprising: at least two modules comprising a leg portion having a top surface and flanges extending upwardly from the top surface of the leg portion; and at least one seat module comprising a seating portion and outer walls at least partially delimiting peripheral openings; wherein, when in an assembled configuration, the top surface of the leg portion is configured to support one of the outer walls of an adjacent one of the at least one seat module with at least one of the flanges of the adjacent one of the at least one seat module being inserted in a corresponding one of the peripheral openings; and wherein, when in an assembled configuration, the at least two modules flank the at least one seat module.

In some embodiments, the at least two modules are a first end module and a second end module.

In some embodiments, the at least one seat module is at least two seat modules, and the at least two modules are a first end module, a second end module, and at least one leg module.

In some embodiments, the flanges on the at least one leg module are opposing flanges that extend upwardly on opposing sides of the top surface of the leg portion.

In some embodiments, the opposing flanges comprises pairs of the opposing flanges.

In some embodiments, a first flange in the pair of the opposing flanges is offset or staggered from a second flange in the pair of the opposing flanges.

In some embodiments, a distance between an outer end of the first flange and an outer end of the second flange is equal to or less than a distance between opposing walls of a respective one of the peripheral openings.

In some embodiments, the at least one leg module is configured to support two adjacent ones of the at least two seat modules.

In some embodiments, the at least one leg module has a length that is equal to or less than a distance between opposing side walls of an underside of the at least one seat module.

In some embodiments, the at least one leg module fits between the opposing side walls on the underside of the at least one seat module via an interference fit.

In some embodiments, the at least two seat modules comprises two or more seat modules and a corner seat module.

In some embodiments, at least one of the first end module and the second end module comprise an arm rest portion extending upwardly from the top surface of the leg portion on an opposing side from the flanges.

In some embodiments, at least one of the first end module and the second end module comprise a protrusion extending upwardly from the top surface of the leg portion on an opposing side from the flanges.

In some embodiments, the modular seating assembly further comprises at least one backrest module comprising a backrest portion and at least one bracket extending outwardly and downwardly from the backrest portion, wherein the at least one bracket is configured to be received in a respective one of the peripheral openings on the at least one seat module.

In some embodiments, the at least one backrest module further comprises a leg support having a top surface configured to support an outer wall of the seat module.

In some embodiments, the peripheral openings are sized and shaped to receive the flanges via at least one of: an interference fit, fastening means, and corresponding attachment mechanisms.

In some embodiments, the seating arrangement is configured for outdoor use.

According to some aspects, there is provided a kit of part comprising a plurality of modules configured to be assembled to form a seating arrangement, the plurality of modules including: at least two modules comprising a leg portion having a top surface and flanges extending upwardly from the top surface of the leg portion; at least one seat module comprising a seating portion and outer walls at least partially delimiting peripheral openings configured to receive at least one of the flanges; and at least one seat cushion configured to cover the at least one seat module.

In some embodiments, the plurality of modules further comprises at least one corner seat module configured to couple on a first side thereof to a respective first one of the at least one seat module and on a front side thereof to a respective second one of the at least one seat module.

In some embodiments, the plurality of modules further comprises at least one corner leg module configured to couple to the front side of the at least one corner seat module.

In some embodiments, the plurality of modules further comprises at least one backrest module comprising a backrest portion and at least one bracket extending outwardly and downwardly from the backrest portion, wherein the at least one bracket is configured to be received in a respective one of the peripheral openings on the at least one seat module.

In some embodiments, the plurality of modules further comprises at least one backrest cushion configured to cover the at least one backrest module.

In some embodiments, one or more of the at least one backrest comprises a leg support extending downwardly from the backrest portion and being configured to support a respective one of the at least one seat module.

According to another aspect, there is provided a method of assembling a modular seating assembly as defined herein, the method comprising: inserting the flanges on a second side of a first one of the at least two modules into the peripheral openings on a first side of a respective one of the at least one seat module; and inserting the flanges on a first side of a second one of the at least two modules into the peripheral openings on a second side of the respective one of the at least one seat module.

In some embodiments, the method further comprises: coupling the flanges on the second side of the first one of the at least two modules to the peripheral openings on the first side of the respective one of the at least one seat module with fasteners; and coupling the flanges on the first side of the second one of the at least two modules into the peripheral openings on the second side of the respective one of the at least one seat module with fasteners.

In some embodiments, the method further comprises: providing at least one backrest module comprising a backrest portion and a bracket configured to be inserted into the peripheral openings in the at least one seat module; and inserting the bracket into the peripheral openings on a backside of the at least one seat module.

According to another aspect, there is provided a modular seating assembly comprising: at least two modules comprising a leg portion having a top surface and flanges extending upwardly from the top surface of the leg portion; and at least one seat module comprising a seating portion and outer walls at least partially delimiting peripheral openings; wherein, when in an assembled configuration, a given one of the at least two modules is configured to support an adjacent one of the at least one seat module, wherein at least one of the flanges of the given one of the at least two modules engages with a corresponding one of the peripheral openings in the adjacent one of the at least one seat module; and wherein, when in an assembled configuration, the at least two modules flank the at least one seat module.

In some embodiments, the at least two modules are a first end module and a second end module.

In some embodiments, the at least one seat module is at least two seat modules, and the at least two modules are the first end module, the second end module, and at least one leg module.

In some embodiments, the at least two seat modules is two or more seat modules and a corner seat module and the at least two modules are the first end module, the second end module, and at least two leg modules.

According to another aspect, there is provided a kit of parts comprising a plurality of modules configured to be assembled to form a seating arrangement, the plurality of modules including: at least two modules comprising a leg portion having a top surface and flanges extending upwardly from the top surface of the leg portion; and at least one seat module comprising a seating portion and outer walls at least partially delimiting peripheral openings configured to receive at least one of the flanges.

BRIEF DESCRIPTION OF THE DRAWINGS

In order that the invention may be readily understood, embodiments of the invention are illustrated by way of example in the accompanying drawings.

DETAILED DESCRIPTION

As used herein, "substantially", "approximately", and/or "about" means an acceptable variation according to conventional standards, otherwise at most a 5% to 10% variation from an indicated effect or value.

There is provided a modular seating assembly that includes a plurality of modules that, when assembled, can form multiple types of seating arrangements. For example, the modular seating assembly can be assembled into a seating arrangement, such as an ottoman, a chair, a loveseat, a 3-seater sofa, a 4-seater sofa, a 3-seater corner sofa, a 4-seater corner sectional sofa, an end sofa, etc. In some embodiments, the seating arrangement is an outdoor seating arrangement, such as a patio chair, patio couch, etc. Some of the modules of the modular seating assembly include a flange and/or bracket that are configured to be inserted in an opening of an adjacent module.

For example, modules that have a leg portion, such as the end modules and/or leg modules, include a flange extending upwardly from a top surface of the leg portion that is configured to be received in an opening in a seat module. Accordingly, two adjacent leg portions can be supported by the surface the assembler is assembling the seating arrangement on, such as the ground, a floor or a patio, and the seat module can be placed on top of the leg portions in a manner that the flanges are inserted into the openings. This allows the assembler to assemble the seating arrangement in an upright position, without having to turn or flip the seating arrangement on its side or back to attach the legs.

The modular seating assembly can also include backrest modules having a backrest portion and brackets extending downwardly from the backrest portion that are configured to be received in an opening in a backside of a seat module. The backrest module can include a leg support that provides additional support for the respective seat module, for example when placed at a corner of a corner sofa seating arrangement.

Figure 1A:
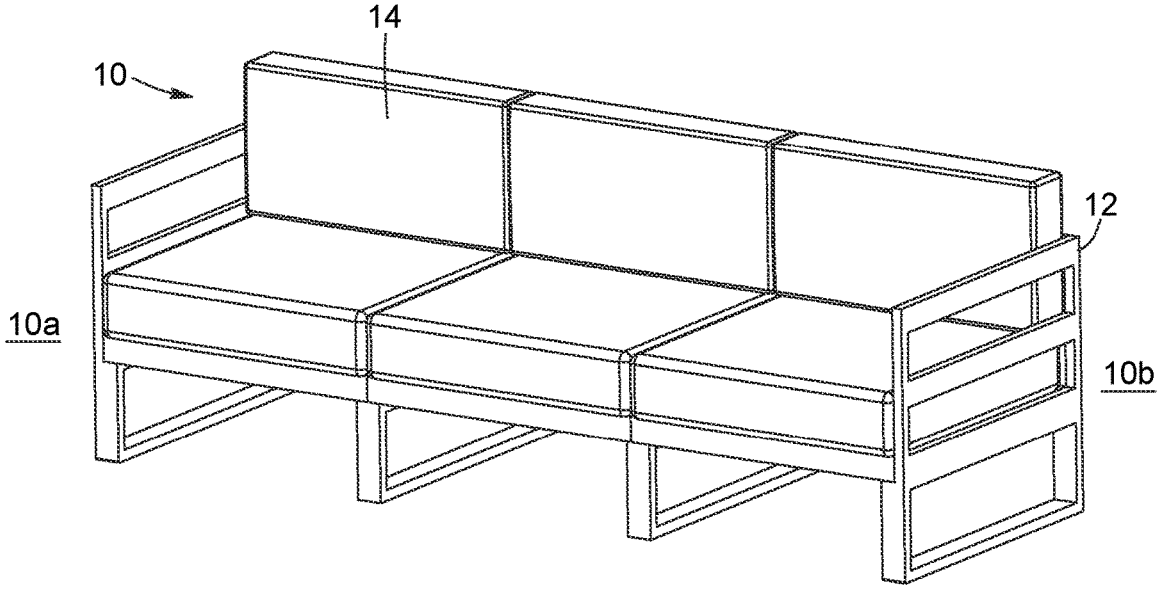
FIG. 1A is a perspective front view of a modular seating assembly according to one embodiment in an assembled configuration as a couch or sofa seating arrangement.
Figure 1B:
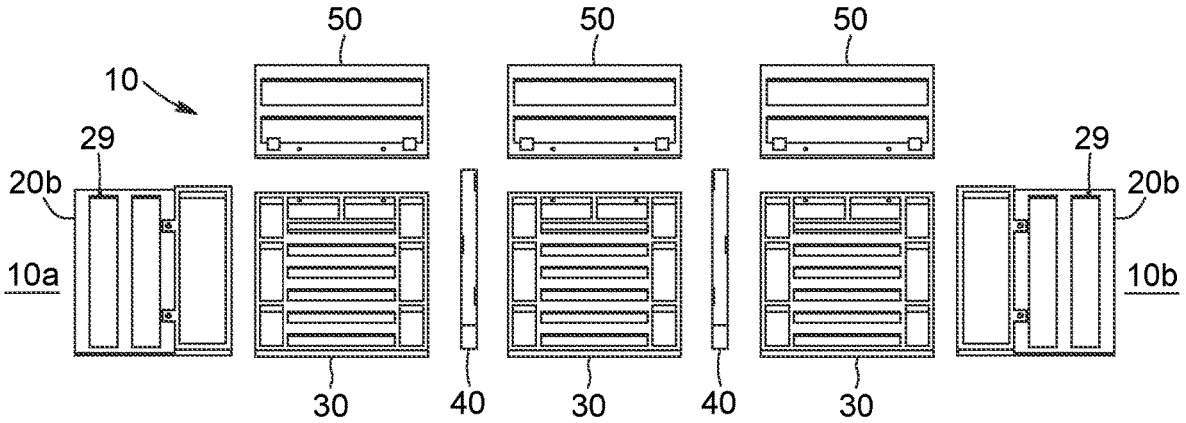
FIG. 1B is a perspective top view of the modular seating assembly shown in FIG. 1A in a disassembled configuration.

Referring to FIGS. 1A and 1B, a modular seating assembly 10 having a first side 10*a* and a second side 10*b* is shown in an assembled configuration and a disassembled configuration, respectively. The modular seating assembly 10 includes a frame 12 comprising a plurality of modules configured to be assembled into a seating arrangement, such as an ottoman, a chair, a couch or sofa, a corner couch or sofa, an end sofa, a daybed, etc.

In the exemplary embodiment, the modular seating assembly 10 is assembled in a sofa seating arrangement. The plurality of modules forming the exemplary sofa seating arrangement includes two end modules 20 (a first end module 20*a* on the first side 10*a* and a second end module 20*b* on the second side 10*b*) flanking three seat modules 30. In the exemplary embodiment, the frame 12 further includes two leg modules 40 couplable to two adjacent seat modules 30 and three backrest modules 50 couplable to a backside of each of the three seat modules 30.

In some embodiments, the modular seating assembly 10 includes cushions 14 or padding that is configured to removably attach or be supported by one or more of the modules, such as the seat module 30 or the backrest module 50. In some embodiments, the cushions 14 can be removably coupled to a module with a fastening means (not shown), such as a hook-and-loop fastener. The modular seating assembly 10 can also include fasteners 16 (for example, as shown in FIG. 12H) that are configured to removably couple two or three adjacent modules to each other. In some embodiments, the fasteners 16 are screws, bolts, or other known attachments means. In the exemplary embodiment, the fasteners 16 are hand tightening bolts.

End Modules

Figure 2A:
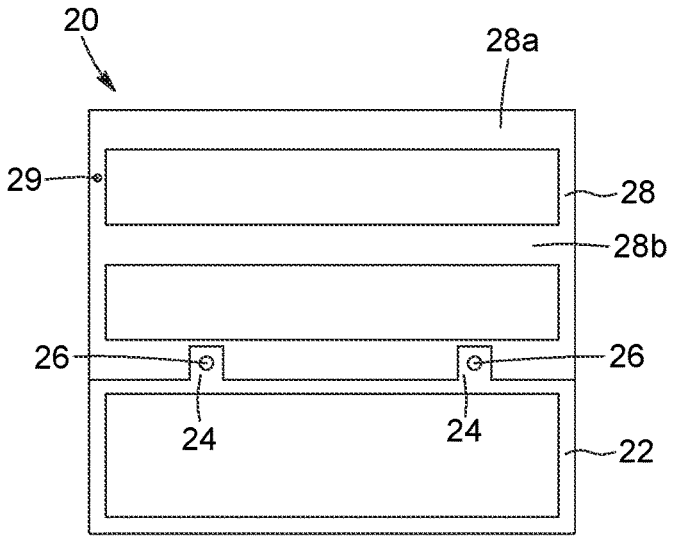
FIG. 2A is a side view of an end module of the modular seating assembly shown in FIG. 1A according to one embodiment.
Figure 2B:
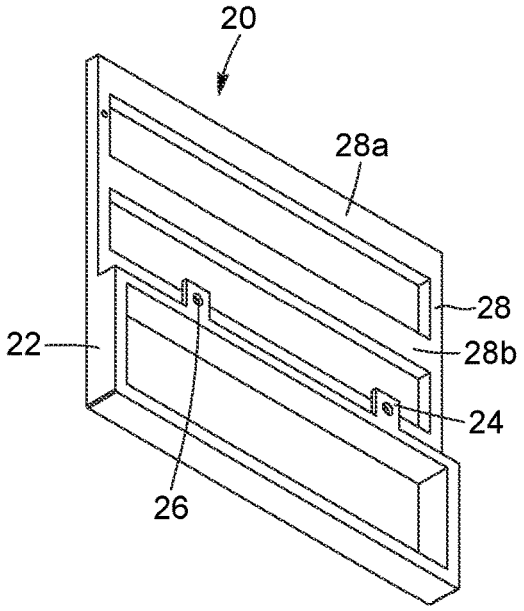
FIG. 2B is a perspective side view of the end module shown in FIG. 2A.
Figure 2C:
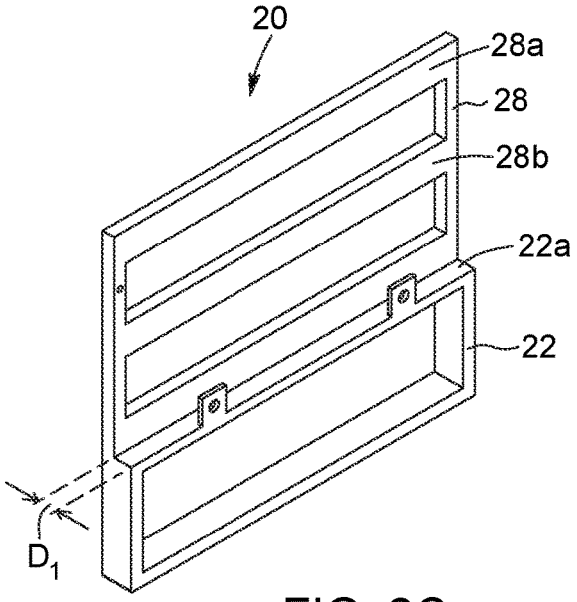
FIG. 2C is another perspective side view of the end module shown in FIG. 2A.

Referring now to FIGS. 2A to 2C, an end module 20 according to one embodiment is shown. Each end module 20 comprises a leg portion 22 configured to rest on a surface and flanges 24 extending upwardly from a top surface 22*a* of the leg portion 22. In the exemplary embodiment, the end modules 20 include an arm rest portion 28 extending upwardly from the top surface 22*a* of the leg portion 22 on an opposing side of the flanges 24. However, it is contemplated that the end module 20 can comprise only the leg portion 22 and the flanges 24.

Figure 3A:
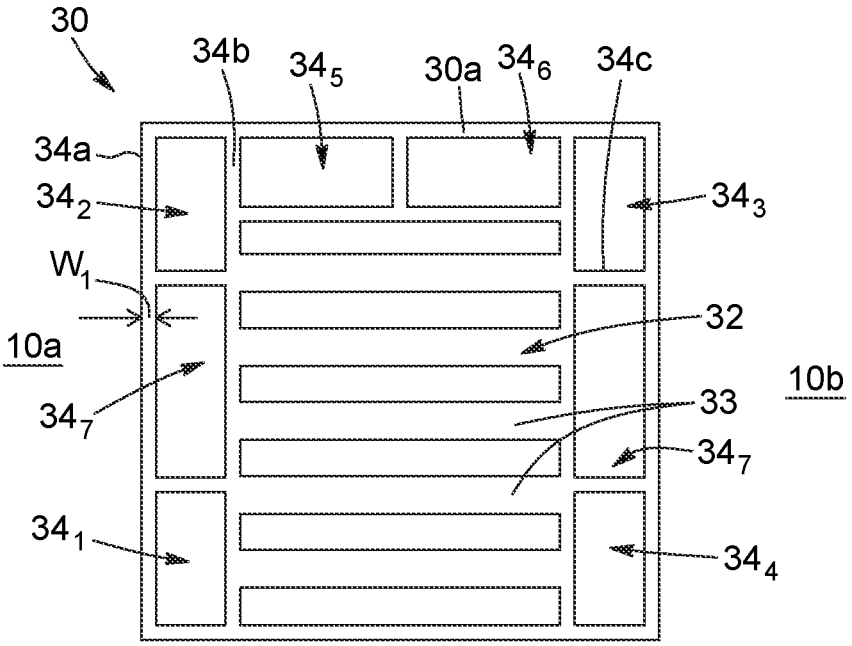
FIG. 3A is a top view of a seat module of the modular seating assembly shown in FIG. 1A according to one embodiment.
Figure 3B:
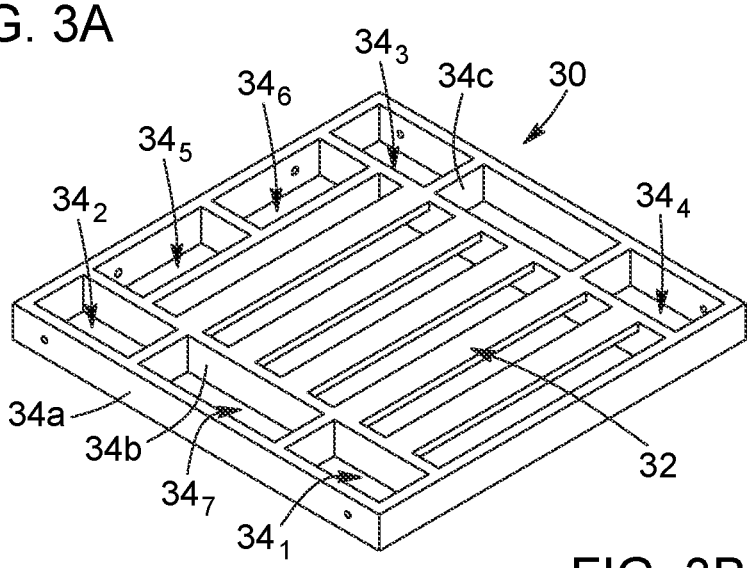
FIG. 3B is a perspective top view of the seat module shown in FIG. 3A.
Figure 3C:
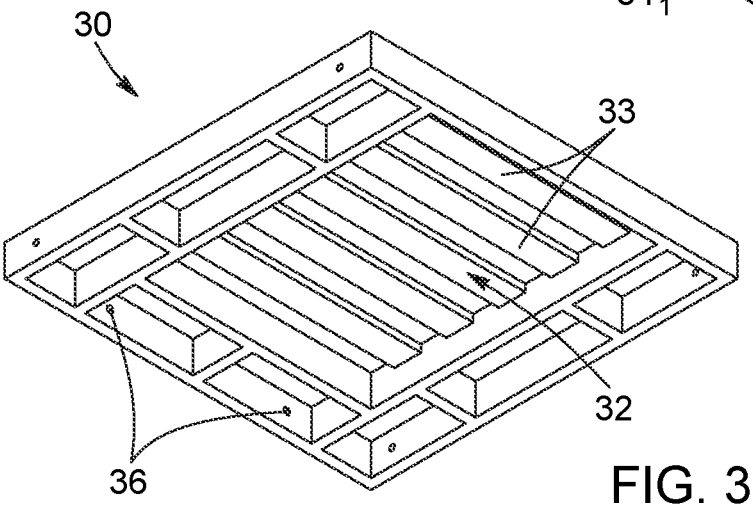
FIG. 3C is a perspective bottom view of the seat module shown in FIG. 3A.

In the exemplary embodiment, the end module 20 includes two flanges 24 extending upwardly from either end of the top surface 22*a*. In this embodiment, the flanges 24 are slightly recessed from the front and back side of the top surface 22*a*. However, it is understood that the flanges 26 can be arranged in any configuration that allows them to be received in a corresponding opening 34 on the seat module 30 (FIGS. 3A to 3C for instance). In the exemplary embodiment, a distance $D_1$ between the first or second side 10*a* or 10*b* of the arm rest portion 28 and an arm rest facing surface of the flanges 24 is equal to or slightly larger than a width $W_1$ of an outer wall 34*a* defining the opening 34 in an adjacent seat module 30 (shown in FIG. 3A). Accordingly, when in the assembled configuration, the outer wall 34*a* of the opening 34 in the adjacent seat module 30 is secured or immobilized between the flanges 24 and the arm rest portion 28, for example by an interference or clearance fit, without requiring fasteners.

In some embodiments, the flanges 24 can include apertures 26 configured to align with holes 36 in the seat module 30. It is understood that other attachment means can also be used, such as the interference or clearance fit, a lip that extends at least a portion of the longitudinal length of the top surface 22*a* of the leg portion 22, or a protrusion configured to be received in a cavity on the adjacent seat module 30. In the exemplary embodiment, the leg portion 22 is couplable to an adjacent seat module 30 via the flanges 24 and apertures 26.

In the exemplary embodiment, the arm rest portion 28 comprises an arm rest 28*a* and a support bar 28*b*. However, it is contemplated that the frame 12 can include any type of arm rest portion 28. For example, the arm rest portion 28 can form an English roll arm, a key arm, a Lawsone arm, a pleated arm, a shelter arm, a sock arm, or a track arm. In the exemplary embodiment, when in the assembled configuration, the arm rest portion 28 is couplable to the first side 10*a* or the second side 10*b*, respectively, of an adjacent backrest module 50 via holes 29.

In embodiments that do not include an arm rest 28, the end modules 20 can include only the leg portion 22 with the flanges 24. In such embodiments, the leg portion 22 can further include a protrusion 27, in the shape of a flange for instance, that extends the length of the top surface 22*a* of the leg portion 22, or a portion thereof, such as shown in FIG. 7C. The protrusion 27 extends upwardly from the top surface 22*a* on an opposing side of the flanges 24, such that a distance between the flanges 24 and the protrusion is equal to or slightly larger than the width $W_1$ of the outer wall 34*a* of the opening 34 in the adjacent seat module 30, as shown in FIG. 3A. Having a protrusion 27 allows the outer wall 34*a* of the seat module 30 to be secured or retained between the flanges 24 and the protrusion, for example by an interference or clearance fit, without requiring fasteners. The protrusion also provides a smooth or uninterrupted side surface to the module seating assembly 10 when in an assembled configuration. Alternatively, in some embodiments, the end modules 20*a*, 20*b* can be replaced with a leg module 40, such as the one shown in FIGS. 4A to 4F. For example, both of the opposing flanges 44 of a leg module 40 can be inserted into the opening 134, such as shown in FIGS. 15A to 15E.

In some embodiments, the frame of the arm rest portion 28 can include one or more holes 29 extending partially or fully therethrough that is configured to receive a fastener to removably couple the end module 20 to an adjacent backrest module 50. Alternatively, the end modules 20 and the backrest modules 50 can include corresponding attachment means, such as a groove and rail, a protrusion and cavity, etc., that allow them to be removably coupled to each other.

In some embodiments, the hole 29 extends partially through the inside surface of the arm rest 28 (i.e., the surface facing a center of the seating arrangement) and is configured to receive a fastener 16 that extends through an adjacent backrest module 50, such that neither the fastener 16 nor the holes 29 are visible from the side when in the assembled configuration. In some embodiments, as shown best in FIG. 1B, the end modules 20*a*, 20*b* on the first side 10*a* and second side 10*b* of the frame 12, respectively, include an opening 29 on a backside thereof that is configured to couple to their respectively adjacent backrest modules 50.

Seat Modules

Referring now to FIGS. 3A to 3C and 3D to 3F, an exemplary seat module 30 and an exemplary corner seat module 30*c* are shown, respectively. The seat module 30 includes a frame 30*a* having a seating portion 32 and openings $\mathbf{34}_{1\text{-}6}$ configured to engage with another modular section of the frame 12, such as the end modules 20, the leg modules 40, and/or the backrest modules 50.

In the exemplary embodiment, the seating portion 32 is flanked on the first side 10*a* and the second side 10*b* by one or more openings $\mathbf{34}_{1\text{-}4}$ configured to receive an attachment means of an adjacent module. The seat module 30 can also include one or more openings $\mathbf{34}_{5\text{-}6}$ positioned on a back side and/or on a front side of the seating portion 32 that are configured to receive an attachment means of an adjacent module, such as a backrest module 50 and/or a seat module 30, such as in a corner sofa seating arrangement.

In the exemplary embodiment, the openings $\mathbf{34}_{1\text{-}6}$ are defined by an outer wall 34*a*, an inner wall 34*b*, and partitioning walls 34*c*. The inner walls 34*b* of the openings $\mathbf{34}_{1\text{-}6}$ can form the outer wall of the seating portion 32 and the outer walls 34*a* of the openings $\mathbf{34}_{1\text{-}6}$ can form the outer wall of the frame 30*a*. In some embodiments, the outer walls 34*a* include holes 36 extending partially or fully therethrough that are configured to receive a fastener 16 to secure the seat module 30 to an adjacent end module 20, seat module 30, leg module 40, and/or backrest module 50. In the exemplary embodiment, each of the openings $\mathbf{34}_{1\text{-}6}$ include a hole 36 extending through their outer walls 34*a*. In the exemplary embodiment, the holes 36 in the openings $\mathbf{34}_5$, $\mathbf{34}_6$ on a backside of the seat module 30 are configured to receive fasteners 16 to fasten a backrest module 50 to the respective seat module 30, whereas the holes $\mathbf{34}_{1\text{-}4}$ on the first side 10*a* and second side 10*b* of the seat module 30 are configured to receive fasteners 16 through a flange 24, 44 of an end module 20 or a leg module 40, respectively, and an adjacent seat module 30 to couple the seat module 30 to the end module 20 or the leg module 40.

Figure 3D:
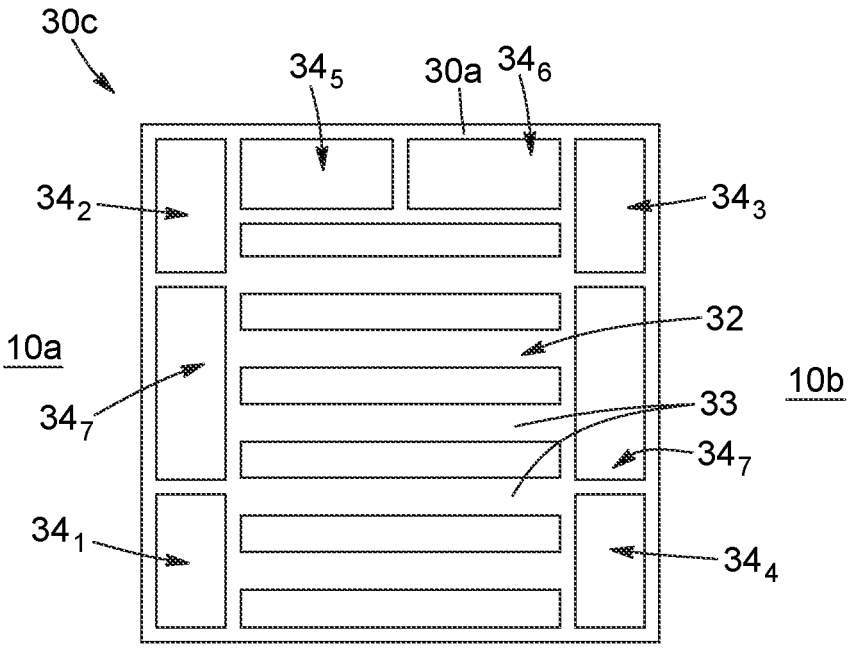
FIG. 3D is a top view of a corner seat module of the modular seating assembly shown in FIG. 1A according to one embodiment.
Figure 3E:
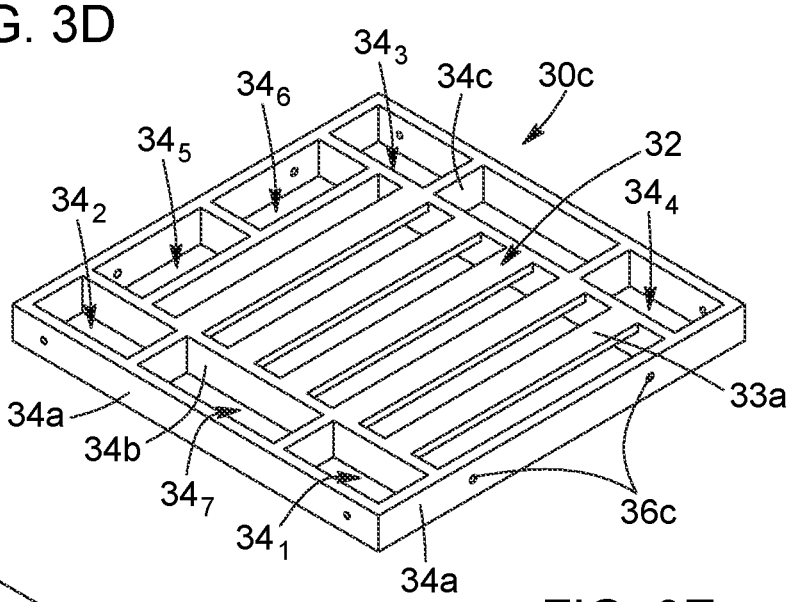
FIG. 3E is a perspective top view of the corner seat module shown in FIG. 3D.
Figure 3F:
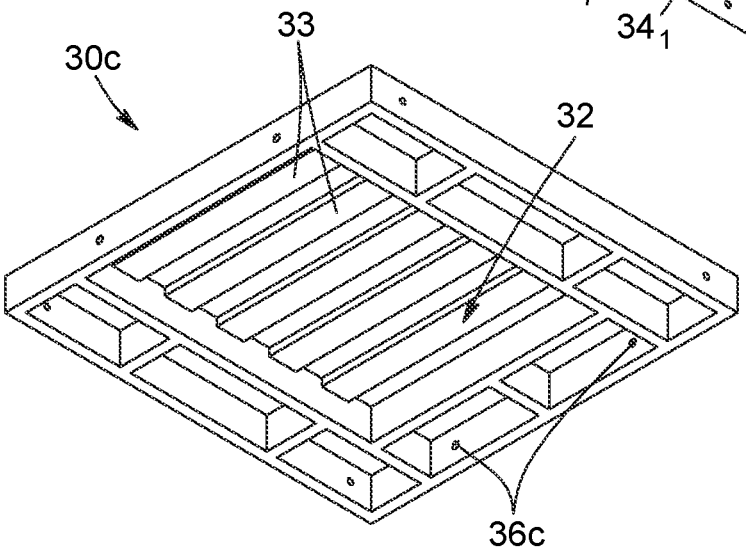
FIG. 3F is a perspective bottom view of the corner seat module shown in FIG. 3D.

With specific reference to FIGS. 3D to 3F, which show a corner seat module 30*c* according to one embodiment, the corner seat module 30*c* can further include holes 36*c* on a front side of the corner seat module 30*c*. As detailed below, when the modular seating assembly 10 is assembled in a corner sofa seating arrangement, the front side of the corner seat module 30*c* can be coupled to a first side 10*a* of an adjacent seat module 30. In some embodiments, the holes 36*c* extend through the outer wall 34*a* of the openings 34 on a front side of the seat module (i.e., the openings $\mathbf{34}_1$, $\mathbf{34}_4$). In the exemplary embodiment, the holes 36*c* extend through the outer wall 34*a* in an opening defined by the front slat 33*a* on a front side of the seat module and the outer wall 34*a*.

The frame 30*a* of the seat module 30 or the corner seat module 30*c* can include further openings $\mathbf{34}_7$, which are defined by the outer wall 34*a*, the inner wall 34*b*, and the partitioning walls 34*c*. The further openings $\mathbf{34}_7$ may or may not receiving a flange or bracket (such as flanges 24, 44 or bracket 54 shown in FIGS. 5A to 5F) from an adjacent module. For example, further openings $\mathbf{34}_7$ can be included to reduce the amount of material in the seat module 30 and/or reduce the overall weight thereof. Alternatively, the further openings $\mathbf{34}_7$ can be configured to receive a flange 24, 44 of an adjacent leg module 20, 40, respectively, and/or a fastener 16 from an adjacent module.

It is understood that the openings (for example, openings $\mathbf{34}_{1\text{-}6}$) that are configured to receive a flange or bracket (for example, flanges 24, 44 or brackets 54), can be of any size and configuration that allows the opening $\mathbf{34}_{1\text{-}6}$ to receive the flange or bracket on an adjacent module. For example, the openings can be a slot or aperture sized and shaped to receive the flanges 24, 44, or brackets 54 via an interference fit. In some embodiments, the adjacent modules can be removably coupled to each other via only an attachment means, which can be the flanges 24, 44 and/or the brackets 54, such that the outer wall 34*a* can be a smooth surface without any holes 36.

In the exemplary embodiment, the seating portion 32 comprises a plurality of slats 33 extending from the inner wall 34*b* of the openings $\mathbf{34}_{1\text{-}2}$ on the first side 10*a* to the inner wall 34*b* of the openings $\mathbf{34}_{3\text{-}4}$ on the second side 10*b*. In some embodiments, the seating portion 32 can include a plurality of slats 33 that extend the width of the seat module 30 (i.e., from the inside surface of the first side 10*a* outer wall 34*a* to an inside surface of the second side 10*b* outer wall 34*a*). In such embodiments, the openings configured to receive the fastening means from an adjacent module can be defined as the space between adjacent ones of the slats 33 or the space between the front or back slat 33 and the outer wall 34*a*.

Slats 33 allow moisture to flow through the seating portion 32, facilitating a quicker drying of the seat module 30 when exposed to moisture, such as rain. However, the seating portion 32 can be any configuration that provides support for the weight being placed on the seat module 30. For example, the seat module 30 can comprise a solid base, a solid base with perforations to allow moisture to drain, a box spring (for example, when the modular seating assembly is configured as a daybed), a woven or interlaced base, a honeycomb base, or any other base that can support the weight being placed on the seat module 30.

It is to be understood that any number of seat modules 30 can be used with the modular seating assembly 10, to create the desired seating arrangement. For example, as detailed below, the modular seating assembly 10 can be arranged to form an ottoman or a chair, both of which would include a single seat module 30. Alternatively, the modular seating assembly 10 can be arranged as a loveseat that includes two seat modules 30, a sofa or couch that includes three, four, or more seat modules 30, depending on the desired length, or a corner sofa, which similarly can include three, four, five, or more seat modules 30 depending on the desired size.

Leg Modules

Figure 4A:
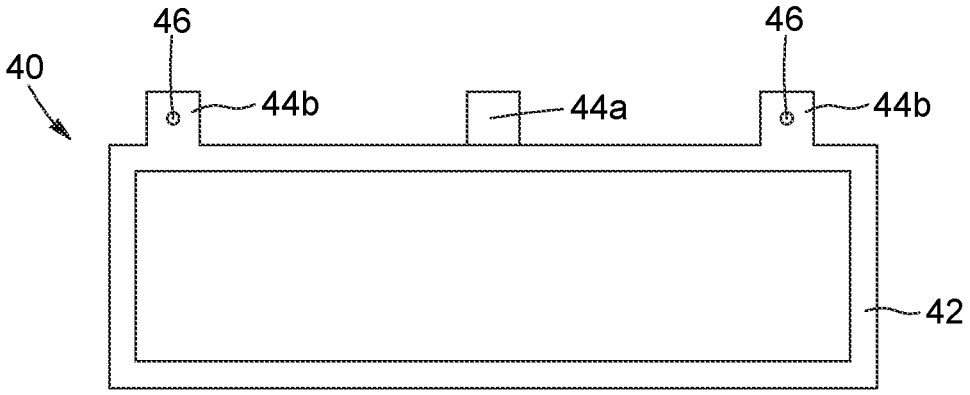
FIG. 4A is a side view of a leg module of the modular seating assembly shown in FIG. 1A according to one embodiment.
Figure 4B:
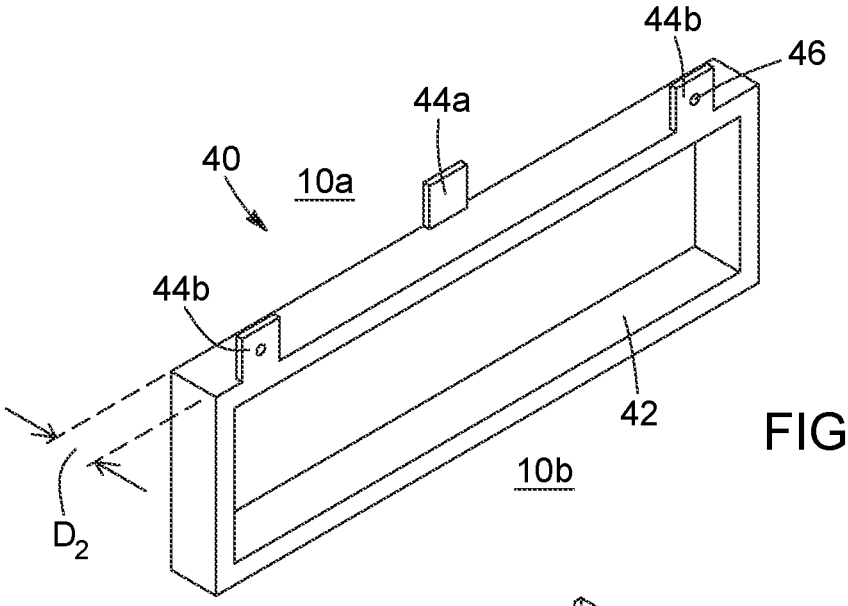
FIG. 4B is a perspective side view of the leg module shown in FIG. 4A.
Figure 4C:
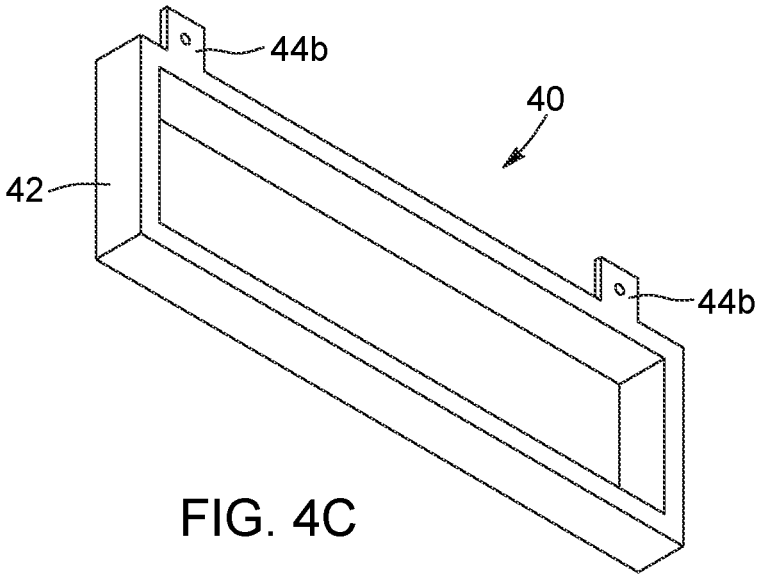
FIG. 4C is a perspective side view of the leg module shown in FIG. 4A.

Referring now to FIGS. 4A to 4C, the leg modules 40 include a leg portion 42 configured to rest on a surface and an attachment means. In the exemplary embodiment, the attachment means includes flanges 44 extending from a top surface 42*a* of the leg portion 42 that are configured to be inserted into one of the openings 34 in the seat module 30. The flanges 44 are positioned on opposing sides of the top surface 42*a*, such that the outer walls 34*a* of two adjacent seat modules 30 can fit between the flanges 44 on opposing sides of the top surface 42*a*. In an assembled configuration, two adjacent seat modules 30 are immobilized between flanges 44 on opposing sides (i.e., the first side 10*a* and the second side 10*b*), such that each leg module 40 supports two adjacent seat modules 30. For example, in the exemplary embodiment, the outer wall 34*a* on the second side 10*b* of a first seat module 30 would be adjacent to a first flange 44*a* on the first side 10*a* of the leg module 40 and the outer wall 34*a* on the first side 10*a* of a second seat module 30 would be adjacent to second flanges 44*b* on the second side 10*b* of the leg module 40. Accordingly, in the exemplary embodiment, the flanges 44 are spaced apart at a distance D2 of about two times the width $W_1$ of the outer wall 34*a* of the opening 34, as shown in FIG. 3A, such that the outer walls 34*a* of the adjacent seat modules 30 (first and second seat modules) fit between the first and second flanges 44*a*, 44*b*.

In some embodiments, the adjacent seat modules 30 are secured to each other and to the corresponding leg module 40 via an interference fit between the openings 34 and the flanges 24, 44 and/or brackets 54 (as shown in FIGS. 5A to 5F). In the exemplary embodiment shown in FIGS. 4A to 4C, each of the flanges 44 include an aperture 46 extending therethrough that is configured to align with a corresponding holes 36 in the seat module 30. A fastener 16, such as a bolt, hand-screw, etc., can be inserted through the holes 36 in the adjacent seat modules 30 and through the aperture 46 on the flange 44 to couple the adjacent seat modules 30 and the leg module 40 together.

It is understood that the flanges 44 can be spaced apart along the length of a top surface of the leg in any orientation that secures, engages or otherwise immobilizes the seat module 30 with respect to the leg module 40 when in an assembled configuration. In the exemplary embodiment, a first side 10*a* of each leg module 40 includes the first flange 44*a* in a center thereof and a second side 10*b* of the leg module includes two second flanges 44*b* at each the ends thereof. However, other configurations are possible, such as two flanges 44 on each of the first and second sides 10*a*, 10*b* of the leg module 40, or flanges 44 spaced apart along a portion or an entire length of the top surface 42*a* of the leg portion 42. In some embodiments the leg portion 42 can include a lip that extends the entire length of the top surface 42*a* or a portion thereof.

In the exemplary embodiment shown in FIGS. 4A to 4C, the leg portion 22 of the end modules 20 and the leg portion 42 of the leg modules 40 each comprise a sled based leg, which comprises a rectangular frame with a planar surface configured to rest on the surface that the modular seating assembly is resting upon. However, other types of leg portions 22, 42 can be used. For example, the leg portions 22, 42 can comprise the top surfaces 22*a*, 42*a* that are configured to include the flanges 24, 44, respectively, with any type of leg extending from a bottom side of the top surface 22*a*, 44*a*, to make contact with the ground. The leg portions 22, 42 can, for example, include one or more legs or feet extending from the ends thereof, or be slightly recessed from one or both ends (i.e., such that the legs or feet are slightly recessed from the front and/or back side of the assembled frame 12). Similarly, for the embodiment shown in FIGS. 5D to 5F, the exemplary support leg 58 is a square leg; however, it is contemplated that the support leg 58 can comprise any type of leg or foot that can support the intended weight.

The legs or feet can be any configuration that supports the intended weight for the assembled frame 12, which may vary depending on the configuration. For example, the legs or feet can include arrow feet, block feet, bracket feet, bun feet, cabriole legs, claw and ball feet, club feet, paw feet, saber legs, spade feet, slayed legs, square legs, tapered block foot, turned legs, etc. In some embodiments, the leg portions 22, 42 can comprise a platform base that comprises a surface between the portion of the leg portion 22, 42 that rests on the surface the seating arrangement is placed upon and the top surface 22*a*, 42*a* of the leg portions 22, 42, respectively. In some embodiments, both the leg portions 22 of the end modules and, if present, the leg portions 42 of the leg modules 40, comprise the same type of legs or feet. In some embodiments, the support leg 58 of the backrest module 50 matches or is aesthetically similar to the leg portions 22, 42 of the end module 20 and the leg modules 40, respectively.

Figure 4D:
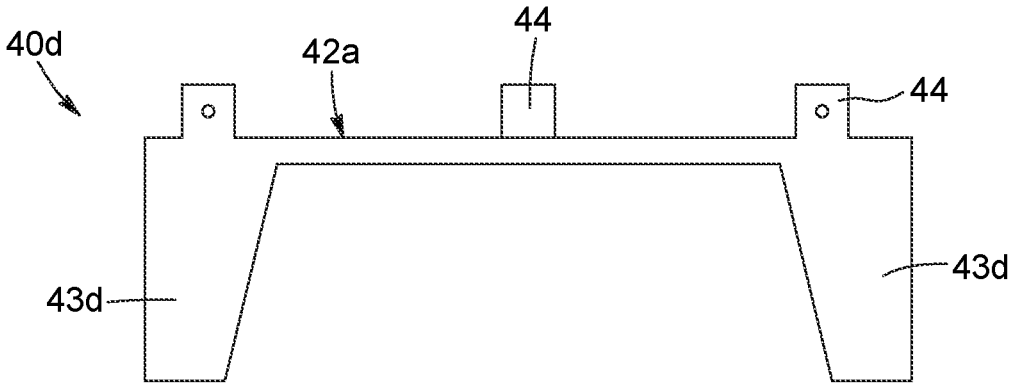
FIG. 4D is a side view of a leg module according to another embodiment.
Figure 4E:
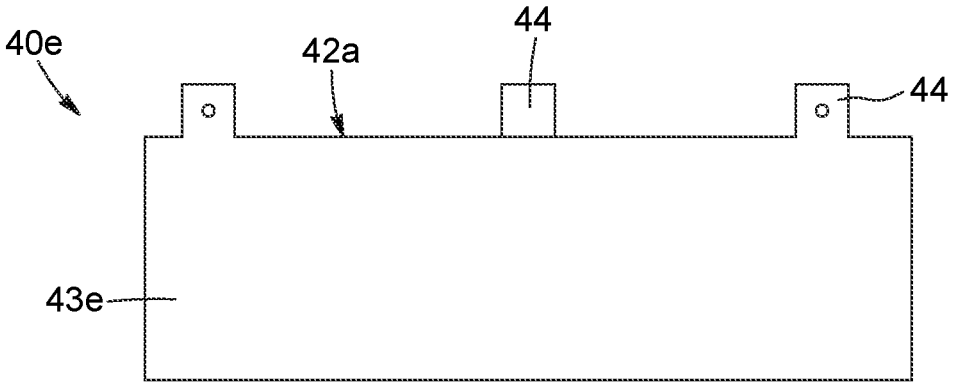
FIG. 4E is a side view of a leg module according to another embodiment.
Figure 4F:
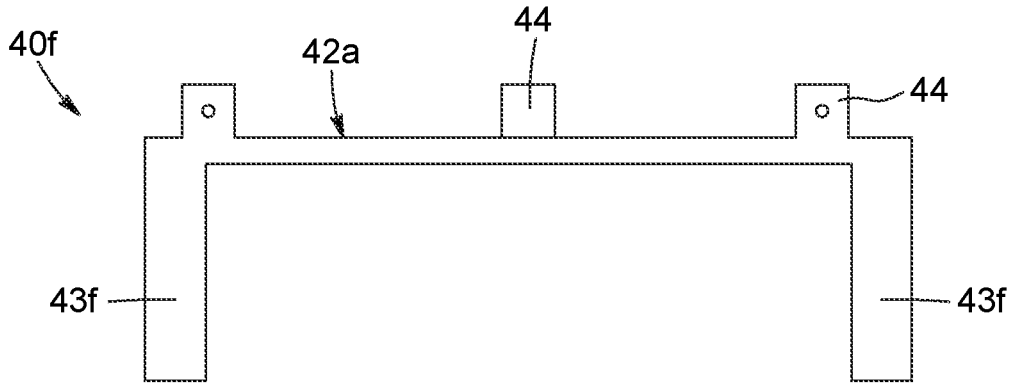
FIG. 4F is a side view of a leg module according to another embodiment.
Figure 5A:
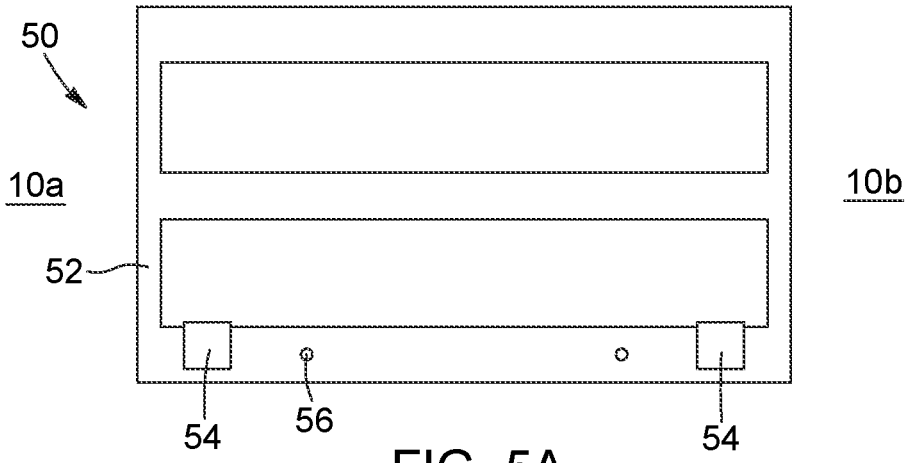
FIG. 5A is a front view of a backrest module of the modular seating assembly shown in FIG. 1A according to one embodiment.
Figure 5B:
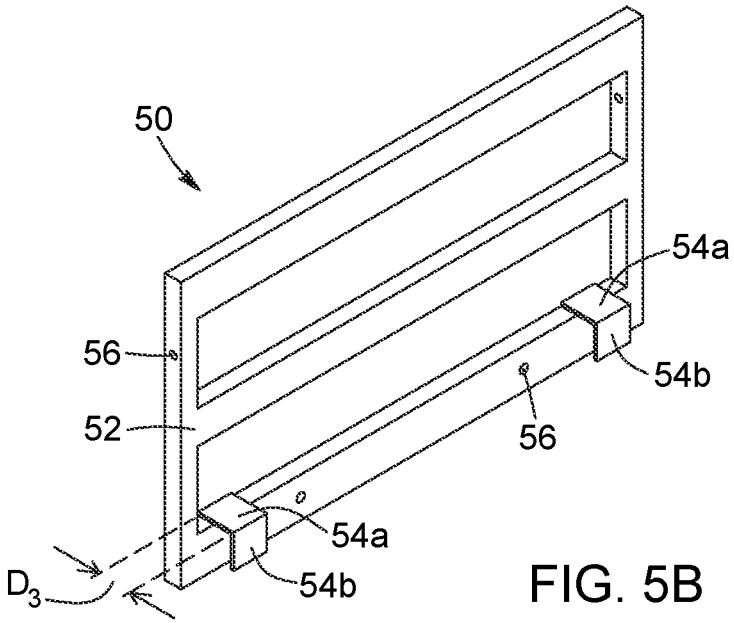
FIG. 5B is a perspective front view of the backrest module shown in FIG. 5A.
Figure 5C:
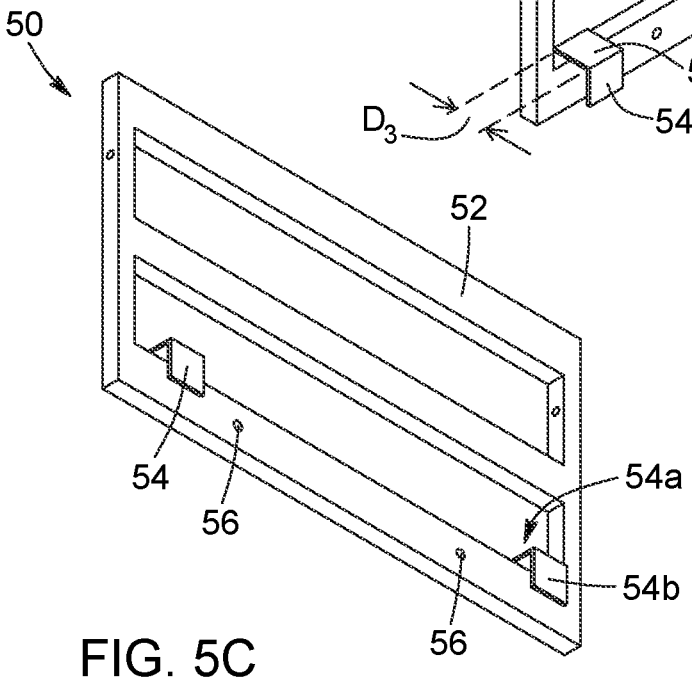
FIG. 5C is another perspective front view of the backrest module shown in FIG. 5A.
Figure 5D:
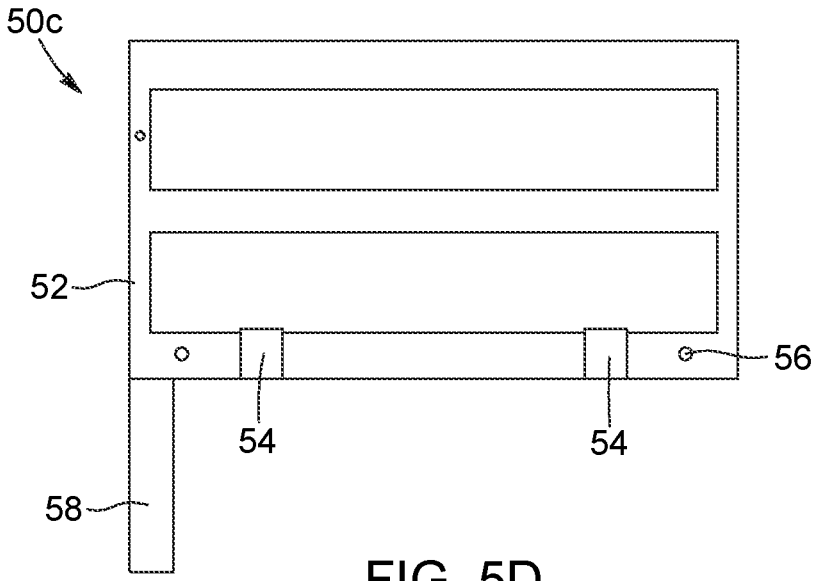
FIG. 5D is a front view of a corner backrest module of the modular seating assembly shown in FIG. 1A according to one embodiment.
Figure 5E:
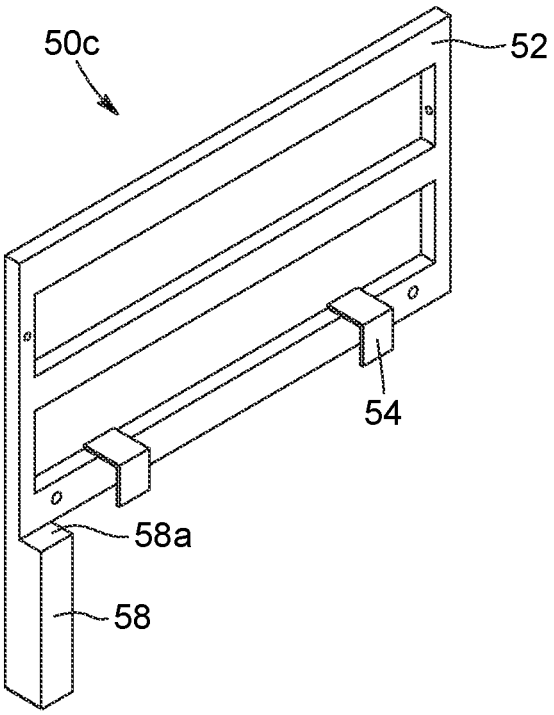
FIG. 5E is a perspective front view of the corner backrest module shown in FIG. 5D.
Figure 5F:
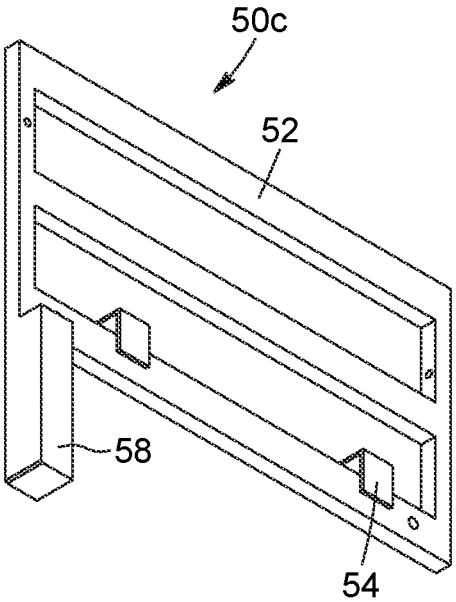
FIG. 5F is another perspective front view of the corner backrest module shown in FIG. 5D.

Referring now to FIGS. 4D to 4F, leg modules 40*d*, 40*e*, 40*f* having different feet or legs according to other non-limitative embodiments are shown. As can be seen, each of the leg modules 40*d*, 40*e*, 40*f* include a leg portion having a top surface 42*a*, and at least one flange 44. The leg portion of the leg module 40*d* shown in FIG. 4D includes tapered block feet 43*d* extending downward from each end of the leg portion; whereas the leg portion 42 of the leg module 40*f* shown in FIG. 4F includes square legs 43*f* extending downward from each end of the leg portion. In some embodiments, such as the leg module 40*e* shown in FIG. 4E, the leg portion 42 can comprise a platform base 43*e* that extends all or a portion of the length of the leg module 40*e*.

Backrest Modules

Referring now to FIGS. 5A to 5F, in some embodiments, the modular seating assembly 10 can include backrest modules 50 couplable to a back side of the seat module 30. The backrest modules 50 can include a backrest portion 52 and brackets 54 configured to engage with the openings $\mathbf{34}_{1\text{-}6}$ on the back side of the seat module 30. In some embodiments, the brackets 54 include a first portion 54*a* extending horizontally from a front side of the backrest module 50 and a second portion 54*b* extending downwardly from the front side of the first portion 54*a*. In some embodiments, a distance $D_3$ between the front surface of the backrest 52 and a back surface of the second portion 54*b* (generally corresponding to a width of the first portion 54*a*) is equal to or slightly larger than the width $W_1$ of the outer wall 34*a* of the corresponding opening 34 of the seat module 30, as shown in FIG. 3A. It is understood that the size and placement of the bracket 54 can be such that when in the assembled configuration, the backrest module 50 can be coupled to a back side of the seat module 30 via a clearance fit and/or an interference fit.

In the exemplary embodiment, the backrest 52 of the backrest module 50 includes holes 56 extending partially or fully through the frame of the backrest 52 that are configured to receive a fastener 16. The holes 56 can be positioned on the first side 10*a* and/or the second side 10*b* of the backrest 52, such that two adjacent backrest modules 50 can be coupled to each other when in the assembled configuration. Other embodiments can include holes 56 extending through the front side of the backrest 52 on the bottom side of the backrest module 50 adjacent to the bracket 54. In other embodiments, the bracket 54 can include an aperture configured to align with an aperture on a back wall of the seat module 30, such that the seat module 30 and the backrest module 50 are couple to each other when in the assembled configuration.

Cushions

Referring back to FIG. 1A, when the module seating assembly 10 is in the assembled configuration, the seat module 30 can be removably coupled to one of the cushions 14 or other padding that is configured to removably attach or be placed upon the seating portion 32. In some embodiments, the cushions 14 are configured to cover the entire top surface of the seat module 30 (i.e., the seating portion 32 and the apertures $\mathbf{34}_{1\text{-}6}$) and/or an entire front surface of the backrest module 50. In other configurations, the cushion 14 or padding can only partially cover the seat module 30, such as a cushion covering the seating portion 32, and/or the backrest module 50.

In some embodiments, the modular seating assembly 10 can further include fastening means (not shown) to engage with and removably couple the cushion 14 to the seat module 30 and/or the backrest module 50. In the exemplary embodiment, the fastening means is a hook-and-loop fastener, such as Velcro™ strips; however, any known fastener means can be used that provides for the removable coupling of the cushions 14.

The cushions 14 can comprise any known fabric and/or padding material, including, without limitation, foam, natural fibers, synthetic fibers, natural filler, synthetic filler, etc. In some embodiments, the cushions 14 are waterproof or water-resistant, such that the seating arrangement can be used outdoors, for example as patio furniture.

Corner Seating Arrangement

Figure 6A:
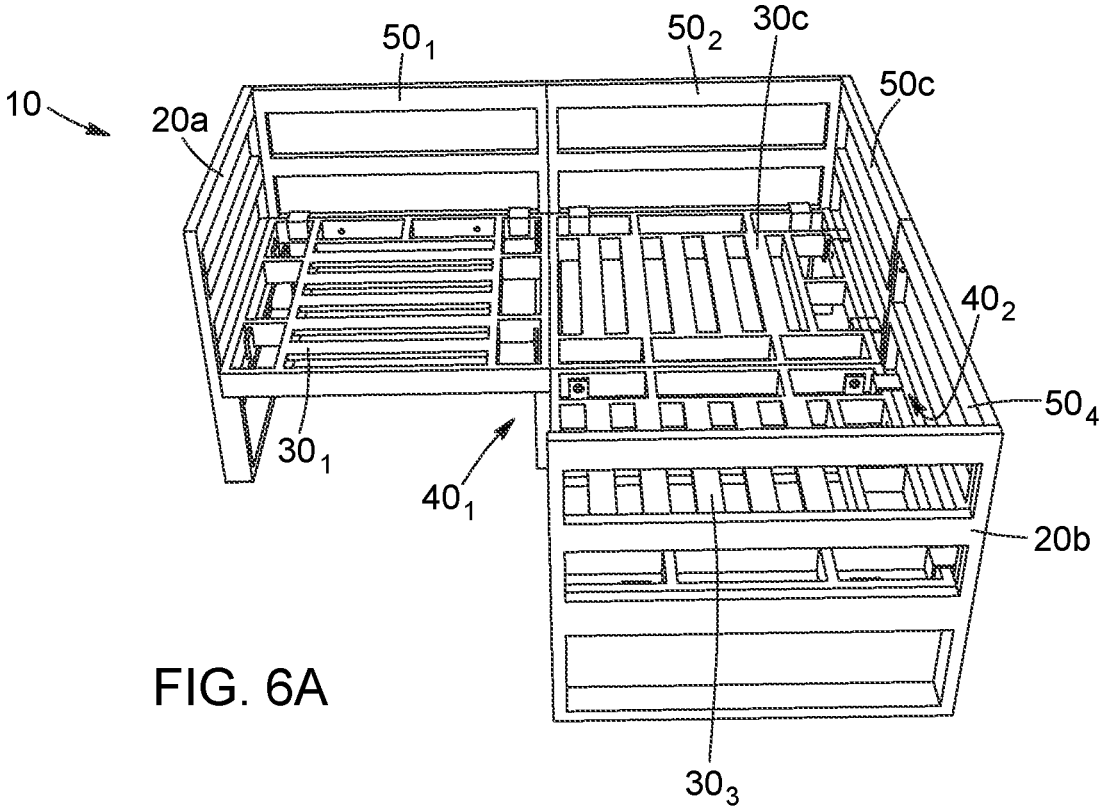
FIG. 6A is a perspective front view of the modular seating assembly shown in FIG. 1A in an assembled configuration as a corner sofa seating arrangement having two seat modules and a corner seat module.
Figure 6B:
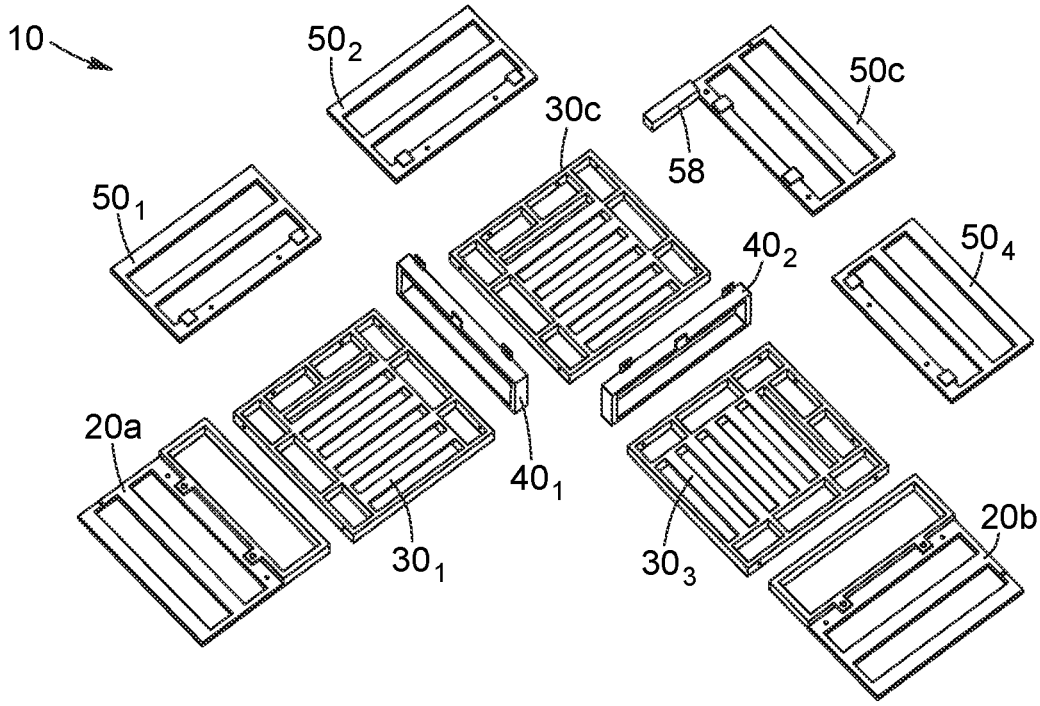
FIG. 6B is a perspective top view of the corner sofa seating arrangement shown in FIG. 6A in a disassembled configuration.

Referring now to FIGS. 6A and 6B, a modular seating assembly 10 assembled in a corner sofa seating arrangement is shown. The modular seating assembly 10 includes the first end module 20*a* and the second end module 20*b* and three seat modules $\mathbf{30}_1$, 30*c*, $\mathbf{30}_3$. The modular seating assembly 10 assembled as a corner sofa differs from the modular seating assembly 10 assembled as a sofa (as shown in FIG. 1A) in that the corner sofa is an L-shaped sofa with the seat modules $\mathbf{30}_1$, $\mathbf{30}_3$ extending in different directions at about a 90 degree angle.

When in the assembled configuration, a first seat module $\mathbf{30}_1$ is adjacent to the first end module 20*a* and a third seat module $\mathbf{30}_3$ is adjacent to the second end module 20*b*. A second side 10*b* of the first seat module $\mathbf{30}_1$ is coupled to a first side 10*a* of a corner seat module 30*c* and a first side 10*a* of the third seat module $\mathbf{30}_3$ is coupled to a front side of the corner seat module 30*c*, such that the first seat module $\mathbf{30}_1$ and the third seat module $\mathbf{30}_3$ are orientated perpendicular to each other via their coupling to the corner seat module 30*c*.

In the exemplary embodiment, the modular seating assembly 10 includes backrest modules 50 coupled to a back side of each of the seat modules 50. As can be seen in FIG. 6A, the modular seating assembly 10 assembled in a corner sofa seating arrangement includes a corner seat module 30*c* that is operatively coupled to a second backrest module 502 on a back side thereof and is operatively coupled to a corner backrest module 50*c* on a second side 10*b* thereof.

Referring back to FIGS. 5D to 5F, in some embodiments, one or more of the backrest modules 50 or the corner backrest module 50*c* can include a leg support 58 configured to rest or support the backrest module 50 or the corner backrest module 50*c* against the ground. In the exemplary embodiment, the backrest modules 50*c* that is coupled to the second side 10*b* of the corner seat module 30*c* includes a leg support 58 on a first side 10*a* thereof. The leg support 58 includes a top surface 58*a* thereof that is configured to engage with an outer corner of the corner seat module 30*c*. For example, in some embodiments, the top surface 58*a* of the leg support 58 can be coupled to the outer surface of the corner seat module 30*c*, can have a shape that engages with a corresponding shape on the corner seat module 30*c* (such as a tongue and rail or protrusion and depression engagement), or can be a support surface that supports the outer frame of the corner seat module 30*c*. In the exemplary embodiment, the top surface 58*a* of the leg support 58 provides a planar surface for the outer corner of the corner seat module 30*c* to rest upon when in the assembled configuration.

It is contemplated that any number of the backrest modules 50 can include a leg support 58, for example to provide more leg support to the modular seating assembly 10. For example, in any seating arrangement having two or more seat modules (for example, a sofa, or a corner sofa), the backrest modules 50 can include a leg support 58 to provide support between the leg modules 40. In some embodiments, the leg support 58 can extend from a center of the bottom side of the backrest module 50, such that any number of the backrest modules 50 in any seating arrangement (for example, an ottoman, a chair, a sofa, or a corner sofa) includes further support for a respective seat modules 30 in a center thereof.

Ottoman Seating Configuration

Figure 7A:
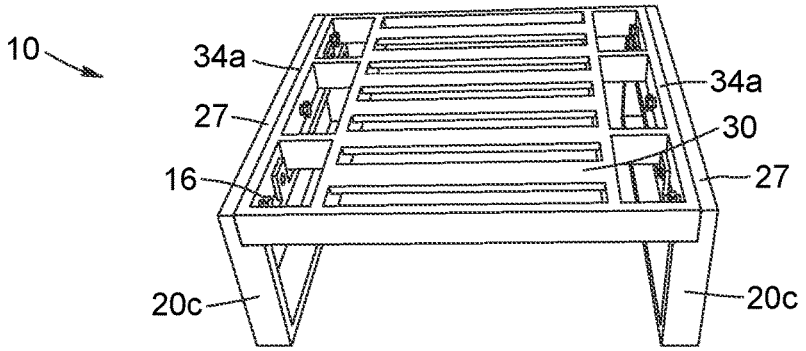
FIG. 7A is a perspective front view of the modular seating assembly shown in FIG. 1A in an assembled configuration as an ottoman seating arrangement.
Figure 7B:
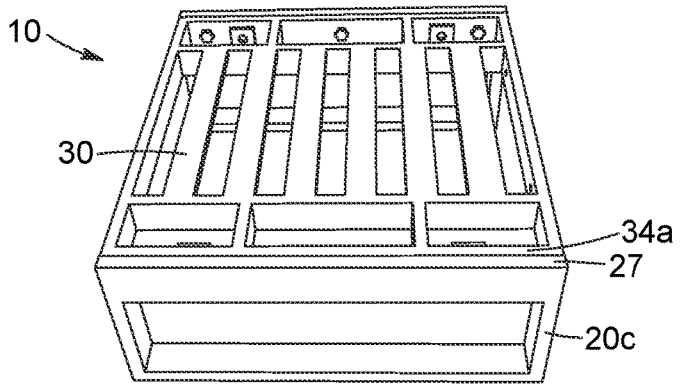
FIG. 7B is a perspective side view of the ottoman seating arrangement shown in FIG. 7A in the assembled configuration.
Figure 7C:
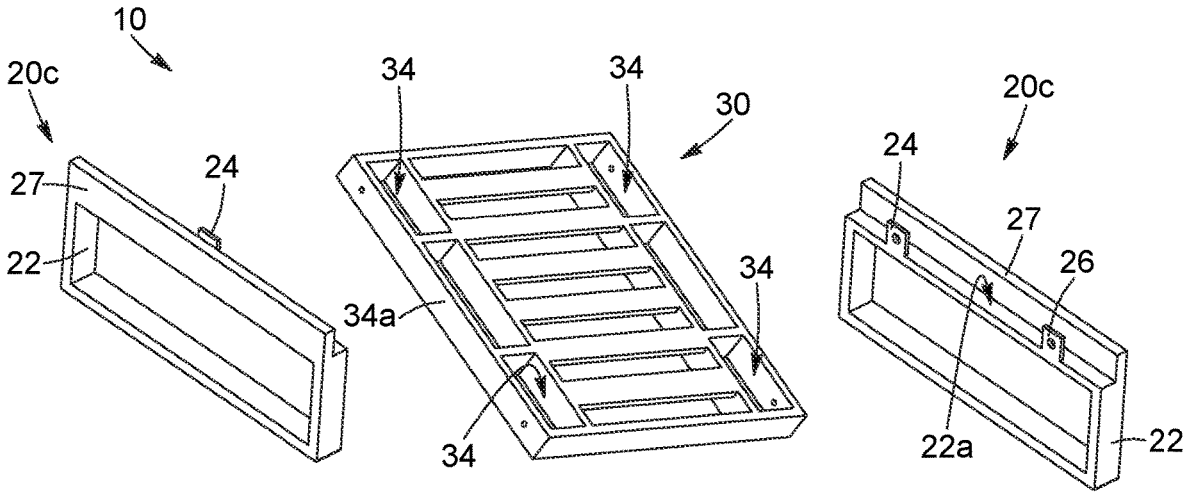
FIG. 7C is a perspective front view of the ottoman seating arrangement shown in FIG. 7A in a disassembled configuration.
Figure 8A:
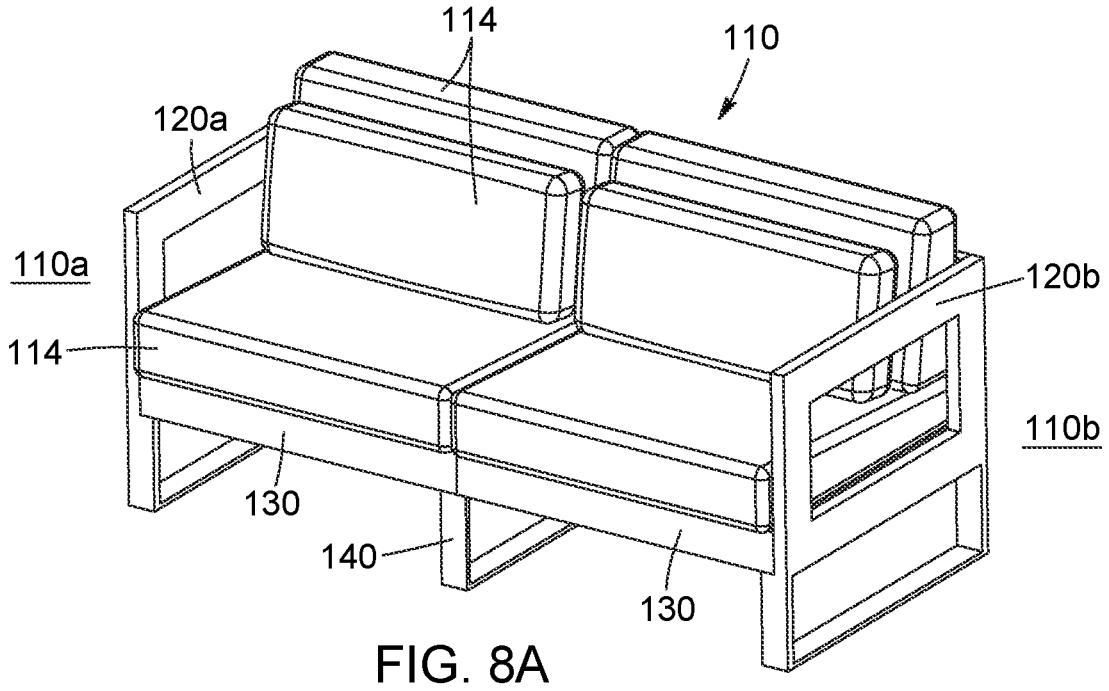
FIG. 8A is a perspective front view of the modular seating assembly accordingly to another embodiment in an assembled configuration as a loveseat seating arrangement.
Figure 8B:
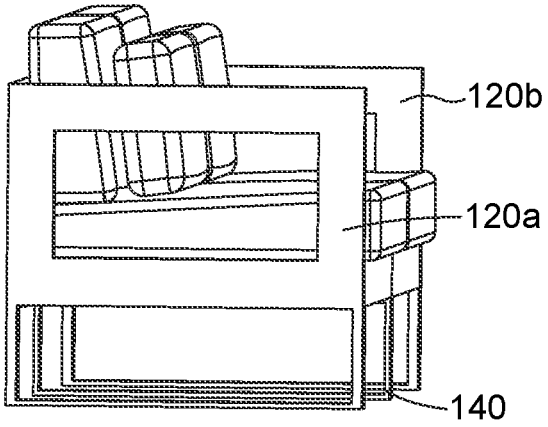
FIG. 8B is a perspective side view of the loveseat seating arrangement shown in FIG. 8A in the assembled configuration.
Figure 8C:
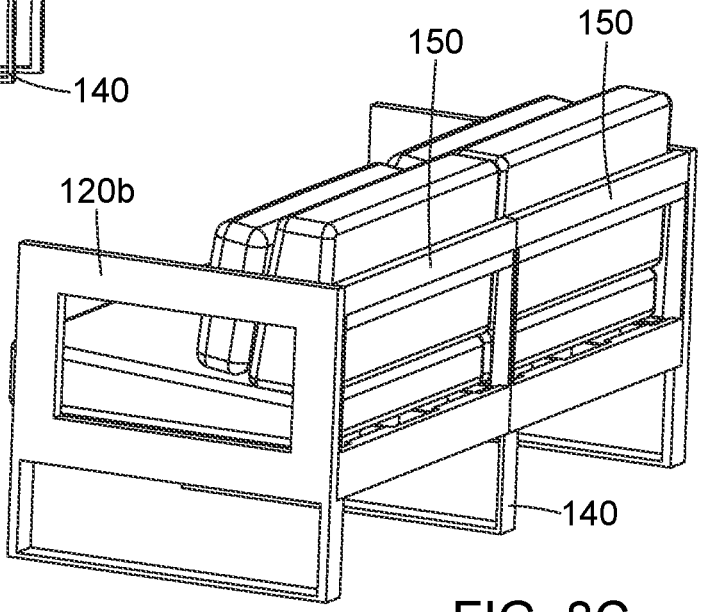
FIG. 8C is a perspective back view of the loveseat seating arrangement shown in FIG. 8A in the assembled configuration.

Referring now to FIGS. 7A to 7C, a modular seating assembly 10 in an assembled configuration (FIGS. 7A and 7B) and a disassembled configuration (FIG. 7C) that is configured to form an ottoman seating arrangement is shown. The modular seating assembly 10 includes two end modules 20*c* and a single seat module 30. The end modules 20*c* include a leg portion 22 having a top surface 22*a* and flanges 24 extending upwardly from the top surface 22*a* on an inner side thereof (i.e., a side facing the seat module 30 in a center of the ottoman seating arrangement). In some embodiments, the flanges 24 can extend upwardly from the inner side of any part of the top surface 22*a*, such as a center thereof or the ends thereof. In the exemplary embodiment, the flanges 24 include apertures 26 configured to receive a fastener 16.

The outer side of the top surface 22*a* (i.e., a side facing an outer side of the ottoman seating arrangement) includes a protrusion 27. Similarly to the end modules with an arm rest 28, a distance between the flanges 24 and the protrusion 27 is equal to or slightly larger than the width $W_1$ of the outer wall 34*a* of the opening 34 in the adjacent seat module 30. The protrusion 27 immobilizes the outer wall 34*a* of the seat module 30 between the flanges 24 and the protrusion 27, for example by an interference or clearance fit, without requiring fasteners. The protrusion 27 also provides a smooth or uninterrupted side surface to the ottoman seating arrangement when in an assembled configuration. In some embodiments, a height of the protrusion 27 is equal to a height of the frame of the seat module 30 and/or a height of the flange 24.

In some embodiments, the protrusion 27 includes holes extending partially of fully therethrough that are configured to receive a fastener 16 to couple the protrusion 27 to the adjacent seat module 130. In some embodiments, the holes extend partially therethrough, such that a fastener 16, extending first through an outer wall 34*a* of the seat module 130, can be received in the hole from an inner side (i.e., the side facing the center of the ottoman) and not show from the outer side of the ottoman seating arrangement.

Other Embodiments

Referring now to FIGS. 8A to 9H, there is provided a modular seating assembly 110 according to another embodiment in an assembled configuration (FIGS. 8A to 8C) and individual modules in a disassembled configuration (FIGS. 9A to 9G). In the exemplary embodiment, the seating assembly 110 includes two end modules 120*a*, 120*b* flanking two seat modules 130 on a first side 110*a* and a second side 110*b* thereof, respectively, to form a loveseat seating arrangement. The seat modules 130 are supported on their outer sides (i.e., the first or second side 110*a*, 110*b* of the assembled seating assembly 110) by the end modules 120*a*, 120*b* and on their inner side (i.e., towards a center of the assembled seating assembly 110) by a leg module 140. In the exemplary embodiment, the seating assembly 110 further includes two backrest modules 150, each coupled to a backside of a corresponding or adjacent seat module 130. The modular seating assembly 110 can further include cushions 114 that are configured to rest upon or be removably coupled to the seat modules 130 and/or the backrest modules 150 when in the assembled configuration.

Figure 9A:
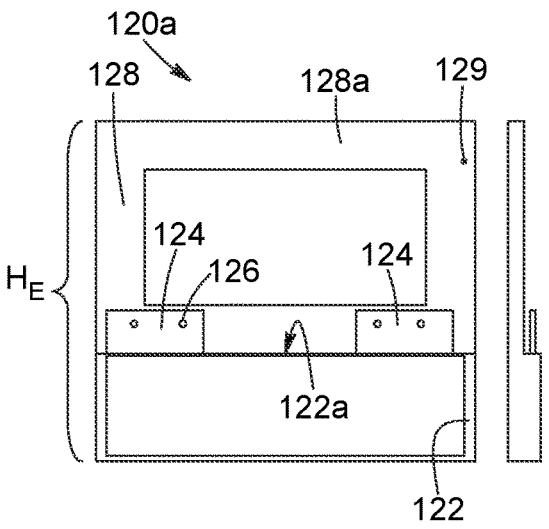
FIG. 9A is a second side view (left) and a front view (right) of a first end module of the modular seating assembly shown in FIG. 8A according to one embodiment.
Figure 9B:
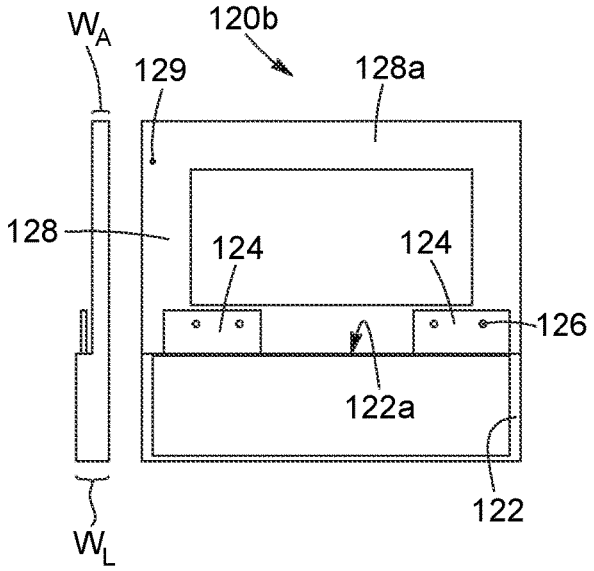
FIG. 9B is a front view (left) and a first side view (right) of a second end module of the modular seating assembly shown in FIG. 8A according to one embodiment.

With specific reference to FIGS. 9A and 9B, the first module 120*a* and the second end module 120*b*, respectively, are shown. The end modules 120*a*, 120*b* each include a leg portion 122 having a bottom side configured to rest on a surface and a top surface 122*a* configured to support an outer side of an adjacent seat module 130 (i.e., a first side 110*a* of the first side 110*a* seat module 130 and a second side 110*b* of the second side 110*b* seat module 130). An inner side of each end module 120*a*, 120*b* (i.e. a second side 110*b* of the first end module 120*a* and a first side 110*a* of the second end module 120*a*) each include flanges 124 that extend upwardly from the top surface 122*a* of the leg portion 122. In the exemplary embodiment, an opposing outer side of each end module 120*a*, 120*b* (i.e., a first side 110*a* of the first end module 120*a* and a second side 110*b* of the second end module 120*a*) each include an arm rest portion 128 extending from the top surface 122*a* of the leg portion 122.

In the exemplary embodiment, the arm rest portion 128 comprises a rectangular frame defining an arm rest 128*a*. However, it is contemplated that the first and second end modules 120*a*, 120*b* can include any type of arm rest portion 128. For example, the arm rest portion 128 can form an English roll arm, a key arm, a Lawsone arm, a pleated arm, a shelter arm, a sock arm, a track arm, and/or any shape configured to support the arm of a user of the seating arrangement.

The arm rest portions 128 can include a hole 129 configured to receive a fastener 16 to couple the first and second end modules 120*a*, 120*b* to an adjacent backrest module 150. In the exemplary embodiment, the holes 129 are positioned on a backside of the first and second end modules 120*a*, 120*b*.

In some embodiments, the first and second end modules 120*a*, 120*b* can be sized and shaped specifically to the type of furniture being assembled. The end modules 120*a*, 120*b* can have a height HE of between about 45 cm and about 90 cm, or between about 55 and about 70 cm. In the exemplary embodiment, the height HE of the end modules 120*a*, 120*b* is 63 cm.

The leg portion 122 of the end modules 120*a*, 120*b* can have a width WL of between about 3 cm and about 9 cm. In the exemplary embodiment, the width WL of the leg portion 122 of the end modules 120*a*, 120*b* is 6 cm. Similarly, the arm rest has a width WA of about 1 cm to about 4 cm, or in the exemplary embodiment, about 3 cm. It is understood that any size and/or shape of end modules 120*a*, 120*b* can be used.

Figure 10A:
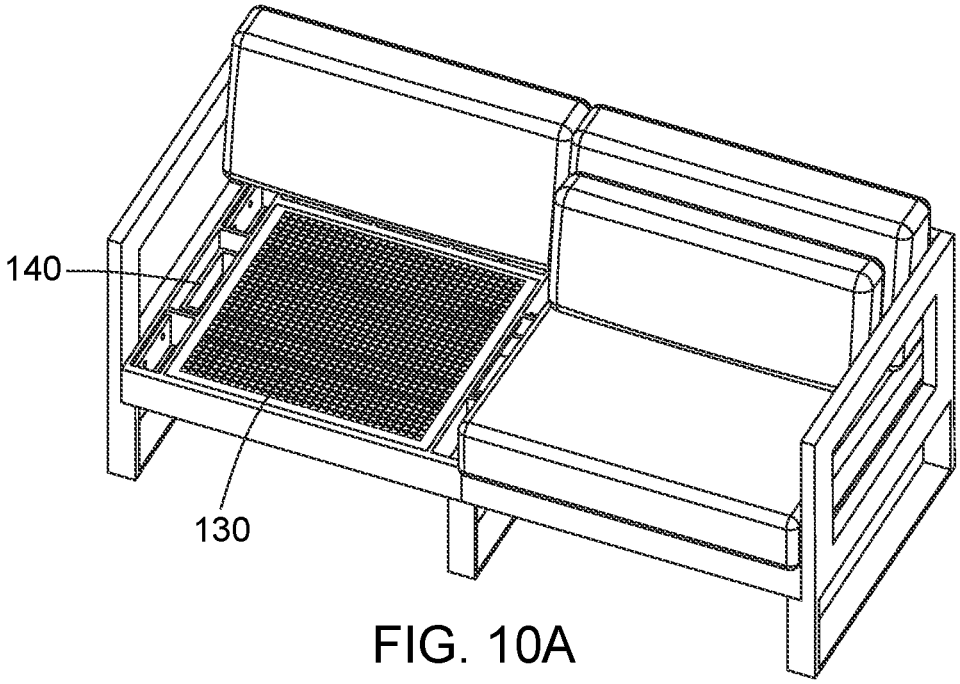
FIG. 10A is a perspective top view of the loveseat seating arrangement shown in FIG. 8A in the assembled configuration.
Figure 10B:
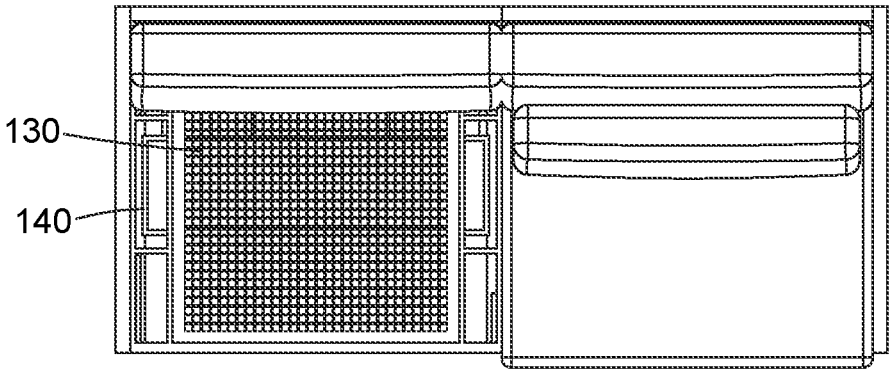
FIG. 10B is a top view of the loveseat seating arrangement shown in FIG. 8A in the assembled configuration.
Figure 10C:
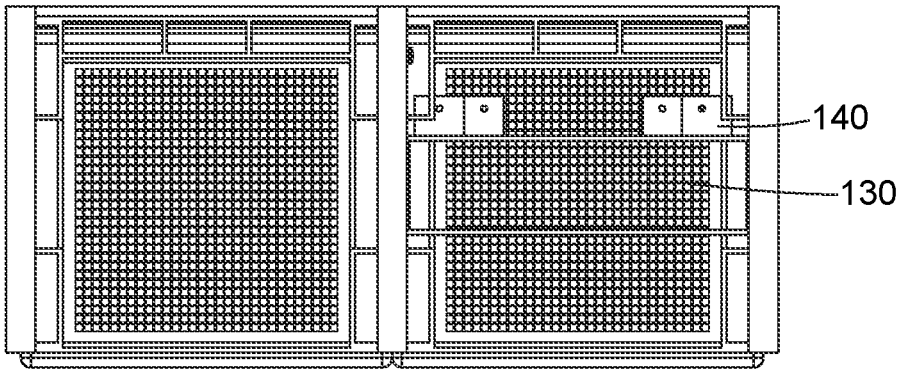
FIG. 10C is a bottom view of the loveseat seating arrangement shown in FIG. 8A in the assembled configuration.
Figure 11A:
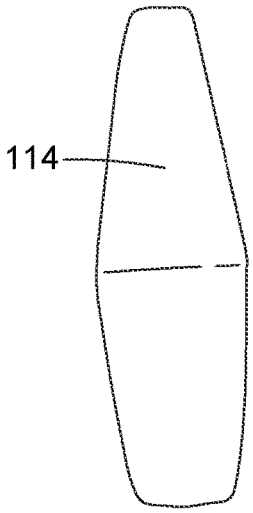
FIG. 11A is a perspective side view of a cushion according to one embodiment.
Figure 11B:
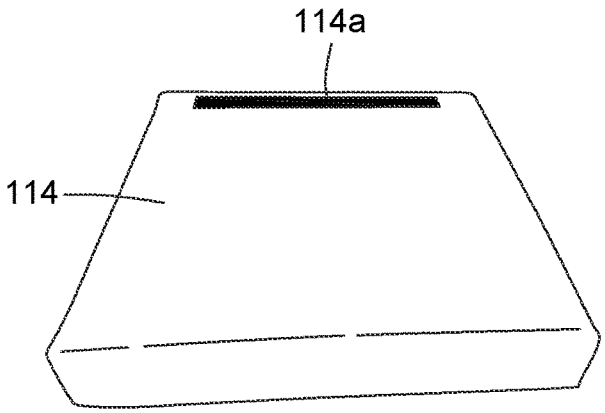
FIG. 11B is a bottom view of a cushion according to another embodiment.
Figure 11C:
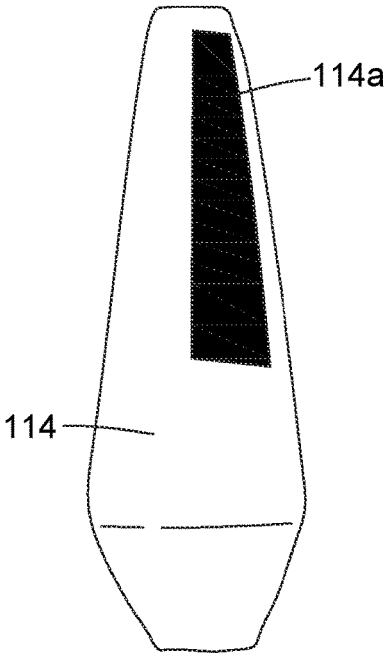
FIG. 11C is a back view of a cushion according to another embodiment.
Figure 11D:
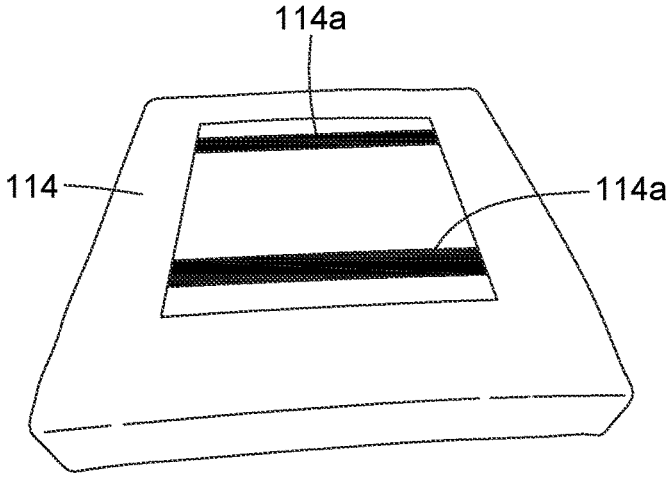
FIG. 11D is a bottom view of a cushion according to another embodiment.

In some embodiments, such as shown in FIGS. 10A to 10C, an underside or bottom side of one or more of the seat modules 130 can be used to store an extra leg module 140. In such embodiments, a depth or length LL of the leg portion 140 is equal to or slightly less than the distance between inner surfaces of opposing side walls of the underside of the seat module 130, such that the leg portion can be stored within the underside of the seat module 130 via one or more of an interference fit, fastening means (for example and without limitation, hand-tightening screws, straps, hook and loop fasteners, etc.), and corresponding attachment mechanisms (such as a rail or cavity on the inner surfaces of the opposing side walls and a groove or protrusion on the leg portion 140).

Figure 9C:
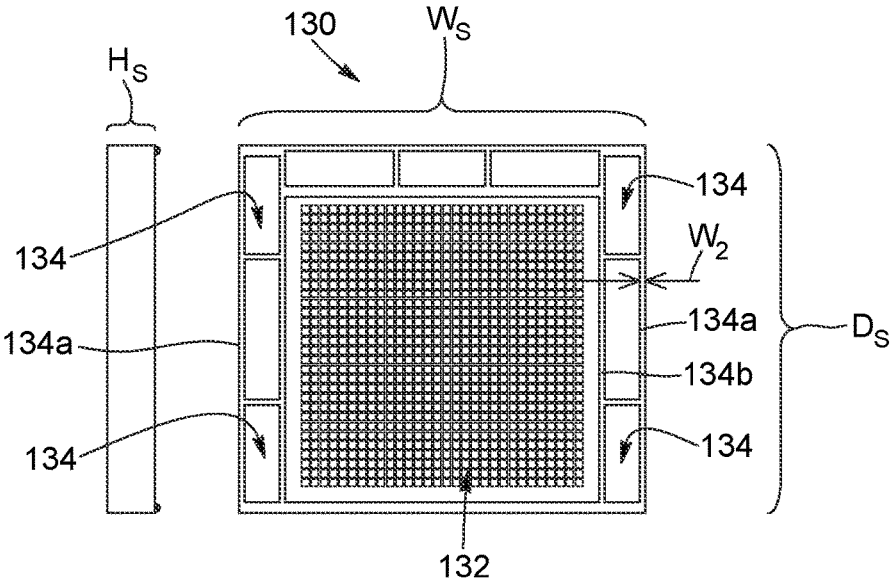
FIG. 9C is a front view (left) and a top view (right) of a seat module of the modular seating assembly shown in FIG. 8A according to one embodiment.

With specific reference to FIG. 9C, a seat module 130 is shown. The seat module 130 includes a seat portion 132 and openings 134 configured to receive the fastening means on adjacent modules, such as flanges 124, 144 or a bracket 154. In the exemplary embodiment, the openings 134 circumscribe three of the four sides of the seat portion 132. The seat module 130 can have a width $W_S$ of about 60 cm to about 90 cm and a depth $D_S$ of about 55 cm to about 90 cm. In the exemplary embodiment, the width $W_S$ of the seat module 130 is about 75 cm and the depth $D_S$ is about 70 cm. The frame of the seat module 130 has a height $H_S$ that is configured to support the weight of a user. Consideration to the size of the seating module 130, the material the seating module 130 is comprised of, and the weight of the potential user should be given when determining the height $H_S$ of the frame of the seating module 130. In some embodiments, the height $H_S$ of the frame of the seat module 130 can be about 7 cm to about 11 cm. In the exemplary embodiment, the seat module 130 has a height $H_S$ of about 9 cm. Consideration to the height of the flanges 124, 144 should also be given when determining the height $H_S$ of the frame of the seat module 130, such that the can provide enough resistance to prevent the seat module 130 from shifting, twisting, moving, or the flanges 124, 144 in the first or second end module 120*a*, 120*b* or leg module 140, respectively, otherwise coming detached from the openings 134 in the seat module 130.

The openings 134 are defined by an outer wall 134*a* that has a width $W_2$. In some embodiments, the width $W_2$ of the outer wall 134*a* can be equal to or slightly smaller than a distance between the flange 124 and the arm rest portion 128 of the first or second end module 120*a*, 120*b* (or when an arm rest portion is not present, between the flange 124 and a protrusion or flange on the outer side of the first or second end module 120*a*, 120*b*) or about half the distance between opposing flanges 144 on a leg module 140.

Figure 9D:
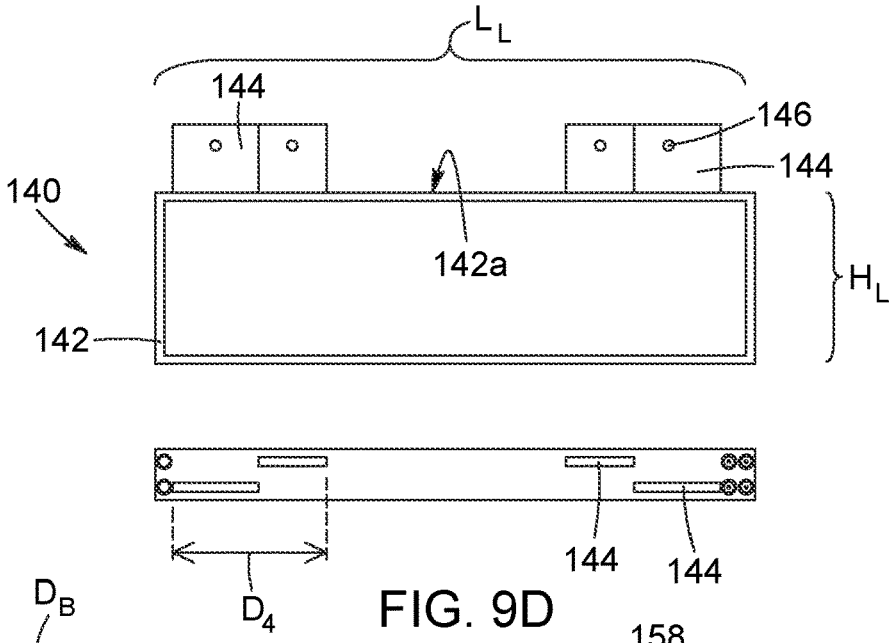
FIG. 9D is a side view (top) and a top view (bottom) of a leg module of the modular seating assembly shown in FIG. 8A according to one embodiment.
Figure 9E:
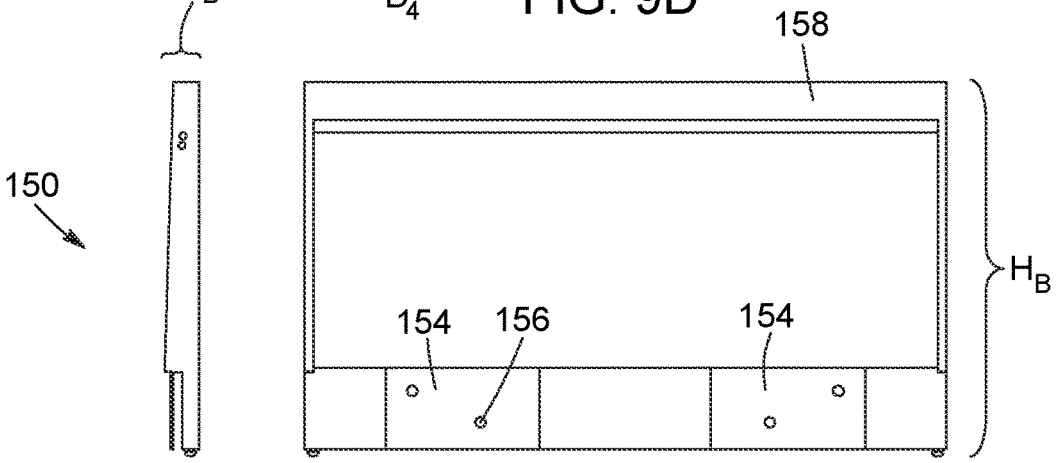
FIG. 9E is a side view (left) and a front view (right) of a seat module of the modular seating assembly shown in FIG. 8A according to one embodiment.
Figure 9F:
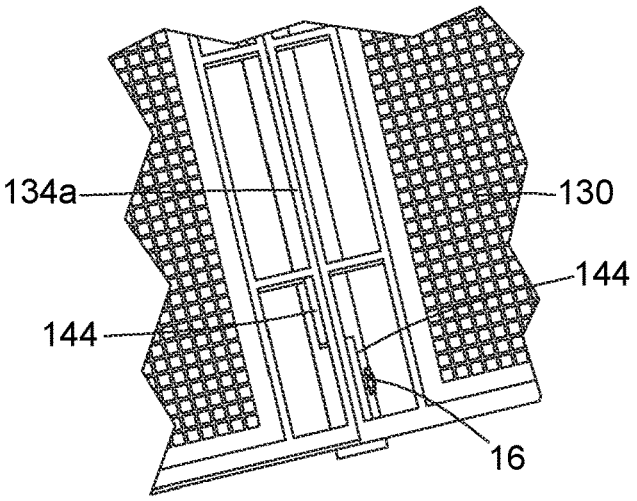
FIG. 9F is an enlarged view of a coupling between two of the seat modules shown in FIG. 9C and the leg module shown in FIG. 9D.
Figure 9G:
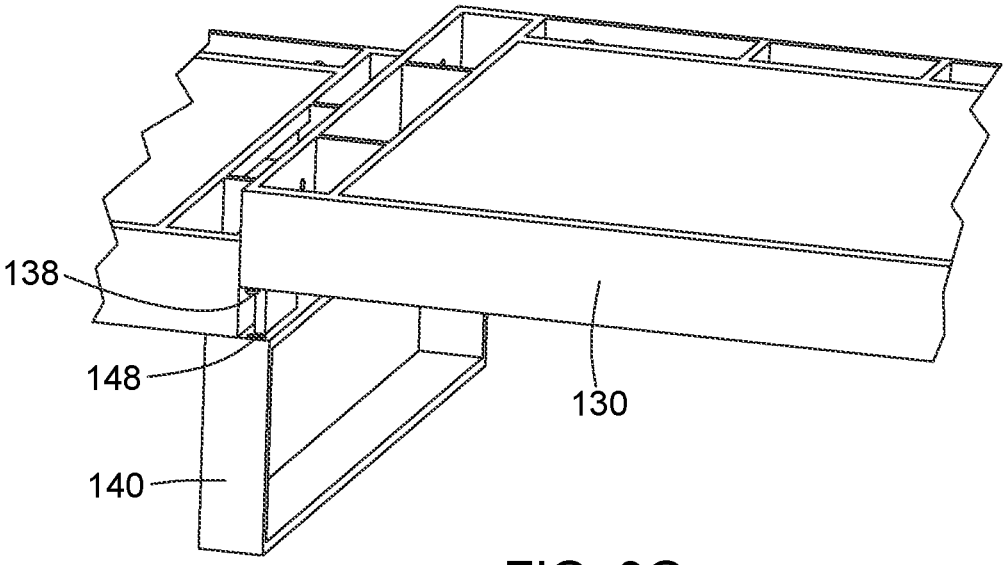
FIG. 9G is an enlarged view of a coupling between two of the seat modules shown in FIG. 9C and the leg module shown in FIG. 9D.

In some embodiments, as shown in FIGS. 9G, the seat module 130 can include a protrusion 138 that is configured to engage with a corresponding cavity 148 on a respective or adjacent leg module 140. The protrusion 138 and cavity 148 are configured to align the seat module 130 with the leg module 140. It is understood that the seat module 130 can include another type of alignment mechanism, such as a rail or cavity that is configured to engage with a corresponding alignment mechanism on the leg module 140, such as a groove or protrusion.

With specific reference to FIG. 9D, the leg module 140 is shown. The leg module 140 includes a leg portion 142 having a top surface 142*a* that is configured to receive and support the outer wall 134*a* of two adjacent seat modules 130. In some embodiments, the leg portion 142 has a height $H_L$ that is between about 1 cm and about 40 cm. In the exemplary embodiment, the height $H_L$ of the leg portion 142 is 20 cm.

Figure 9H:
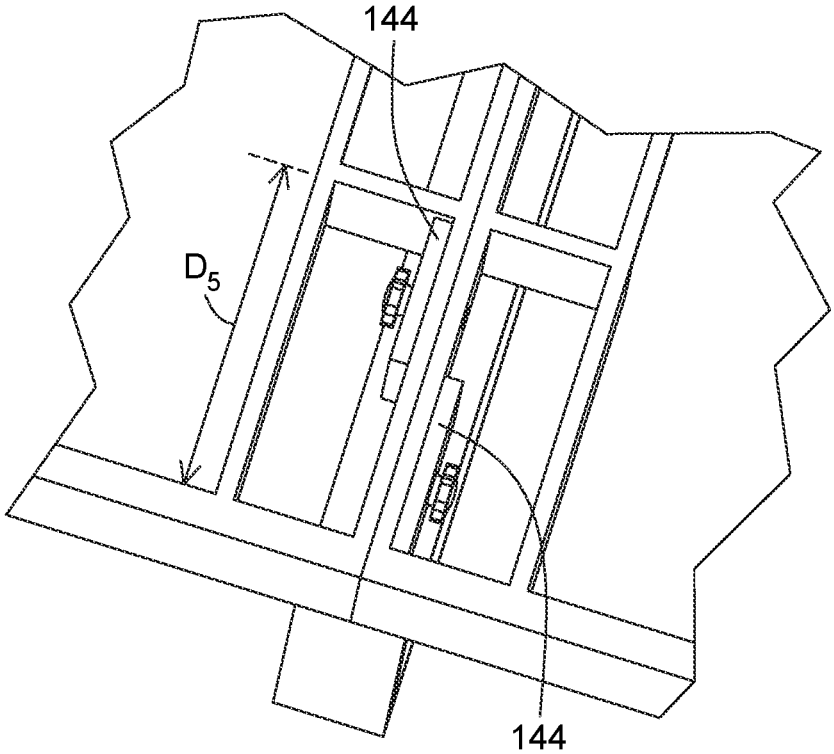
FIG. 9H is an enlarged view of a coupling between two of the seat modules shown in FIG. 9C and the leg module shown in FIG. 9D.

In the exemplary embodiment, the leg portion 142 includes a pair of opposing flanges 144 on a front side thereof and a pair of opposing flanges 144 on a back side thereof that extend upwardly from the top surface 142*a*. Individual ones of each pair of flanges 144 are staggered or offset matter from each other, as best shown in FIGS. 9F and 9H. Having two adjacent, offset flanges 144 coupling the leg modules 140 to two adjacent seat modules 130 can provide a secure fastening between the flanges 144 by immobilizing the seat modules 130 between the opposing flanges 144. Such immobilization can, for example, prevent the outer wall 134*a* of the openings 134 in the seat module 130 from twisting or moving between the opposing flanges 144. In some embodiments, a distance $D_4$ between the ends of the staggered or offset pairs of opposing flanges 144 (i.e. a combined width of one pair of opposing flanges 144) is equal to or slightly less than the distance $D_5$ between opposing walls of the opening 134 in the seat module 130, as shown in FIG. 9H.

In some embodiments, some or all of the flanges 144 include an aperture 146 configured to align with a hole in the seat module 130. In some embodiments, each of the flanges 144 includes two or more apertures 146. In some embodiments, the apertures 146 in the same flange 144 are offset from each other.

With specific reference to FIG. 9E, the backrest module 150 is shown. The backrest module 150 includes a backrest portion 152 and brackets 154 that are configured to be inserted into an opening 134 on a backside of the seat module 130. In some embodiments, the backrest portion 152 has depth DB of between about 2 cm and about 8 cm and a height $H_B$ of between about 30 cm and about 60 cm. In the exemplary embodiment, the backrest portion 152 has an overall depth DB of about 4 mm and a height $H_B$ of about 43 cm. As can be seen, the brackets 154 can include one or more apertures 156 configured to receive a fastener 16. In the exemplary embodiment, the brackets 154 includes two apertures 156 that are offset or staggered from each other.

The backrest portion 152 of the backrest module 150 can be sized and shaped accordingly to the type of furniture, the style of furniture, etc. In the exemplary implementation, the backrest portion 152 has a tapered shape. However, other shapes and sizes are also contemplated, such as one or more of the backrest modules 150 forming a shape of the overall seating arrangement backrest, such as a camel back, a channel back, a curved back, a tight back, or a waterfall back. In some embodiments, the backrest modules 150 can be padded or have cushions integrated into the backrest portion 152 or the backrest portion 152 can be configured to support or be fastened to one or more cushions 114. In the exemplary embodiment, the backrest portion 152 is configured to support a cushion 114.

Referring now to FIGS. 11A to 11D, cushions 114 according to different embodiments are shown. When the module seating assembly 110 is in the assembled configuration, the cushions 114 can be supported by or removably coupled to one or more of the seat modules 130 and/or the backrest module 150. In some embodiments, the seat module 130 can further include fastening means (not shown) to engage with and removably couple the cushion 114 to the seat module 130 and/or the backrest module 150. In the exemplary embodiment, the fastening means is a hook-and-loop fastener, such as Velcro™ strips; however, any known fastener means can be used that provides for the removable coupling of the cushions 114.

In the exemplary embodiment, a first part 114*a* of the fastening means is coupled to a bottom side of the cushion 144 and a second part of the fastening is coupled to the top surface of the seat module 130, such that, when in contact, the first part 114*a* and the second part form a removable attachment between the cushion 114 and the seat module 130.

Assembly of Seating Assembly

Referring now to FIGS. 12A to 14H, a method of assembling the modular seating assembly 10 is shown. As an optional first step, the assembler can place the various modules in their desired configuration, such as shown in FIGS. 1B, 6B, and 7C. It is to be understood that any number of seat modules 30, 130 can be used with the modular seating assembly 10, 110, to create the desired seating arrangement. For example, as detailed below, the modular seating assembly 10, 110 can be arranged to form an ottoman or a chair, both of which would include a single seat module 30, 130. Alternatively, the modular seat assembly 10, 110 can be arranged as a loveseat that includes two seat modules 30, 130, a sofa or couch that includes three, four, or more seat modules 30, 130, depending on the desired length, or a corner sofa, which similarly can include three, four, five, or more seat modules 30, 130 and one or more corner seat modules 30*c* depending on the desired size.

Figure 12A:
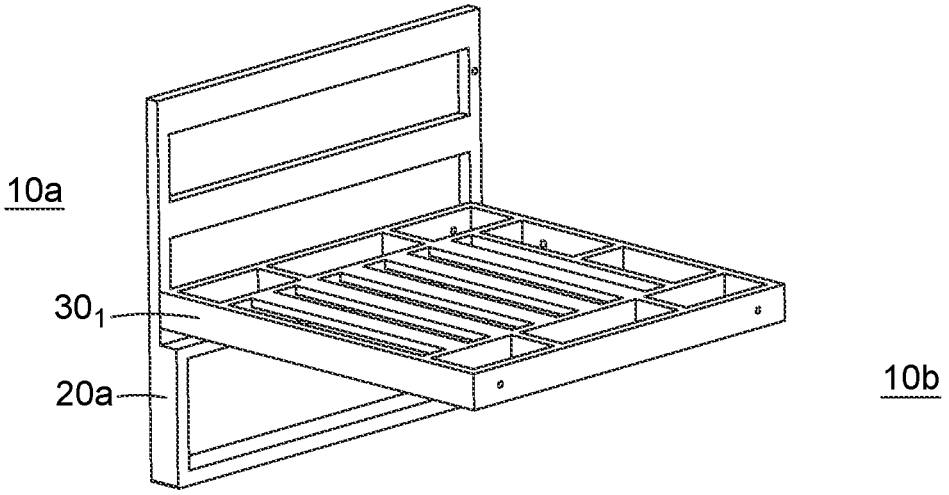
FIGS. 12A to 12J are perspective views of the modular seating assembly shown in FIG. 1A being assembled into a sofa seating arrangement.
Figure 12B:
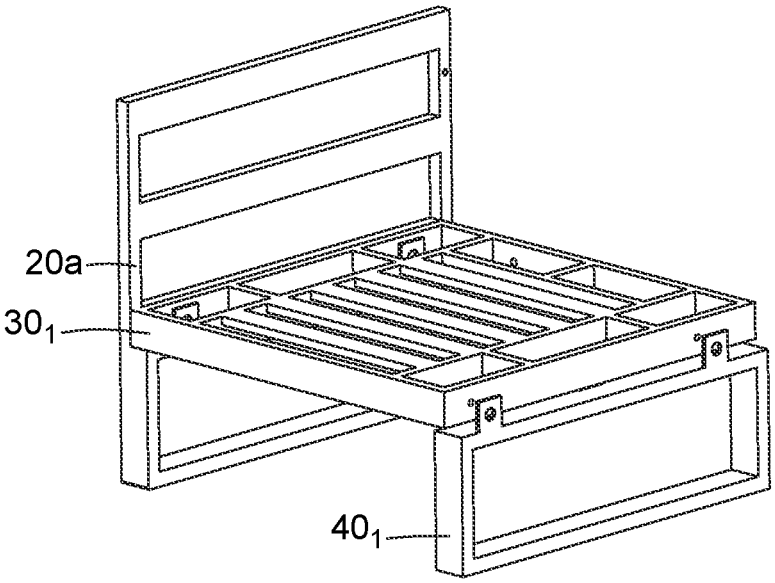
Figure 13A:
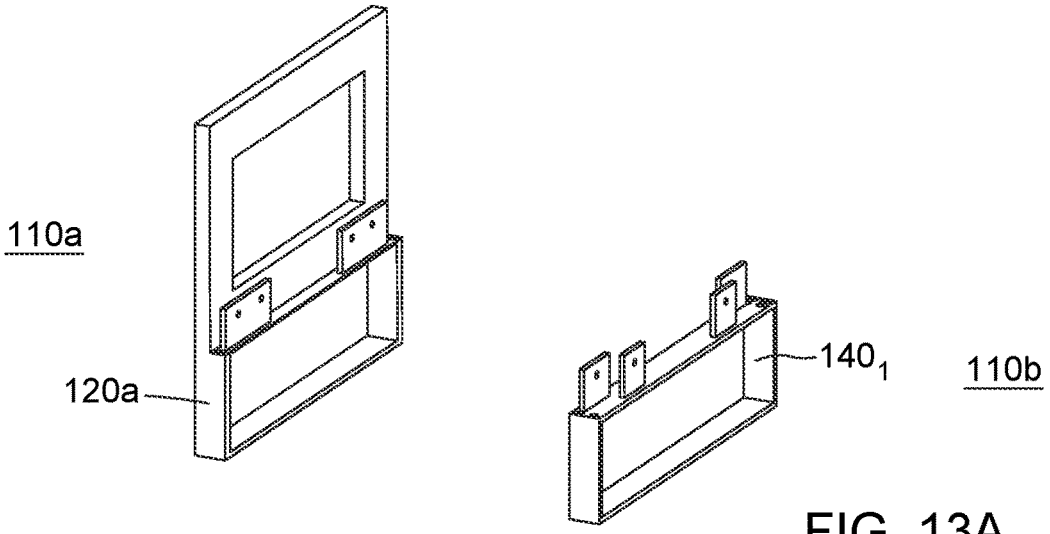
FIGS. 13A to 13I are perspective views of the modular seating assembly shown in FIG. 8A being assembled into a loveseat seating arrangement.
Figure 13B:
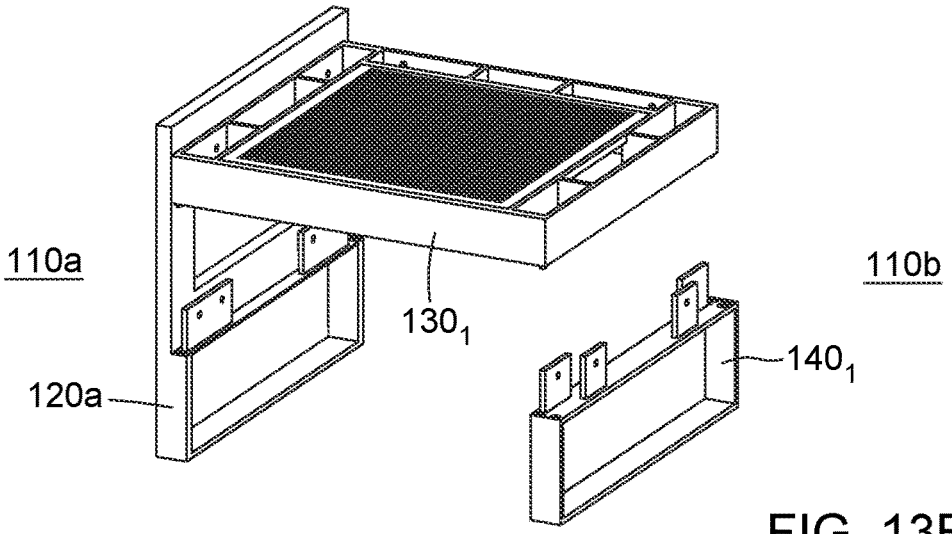
Figure 13C:
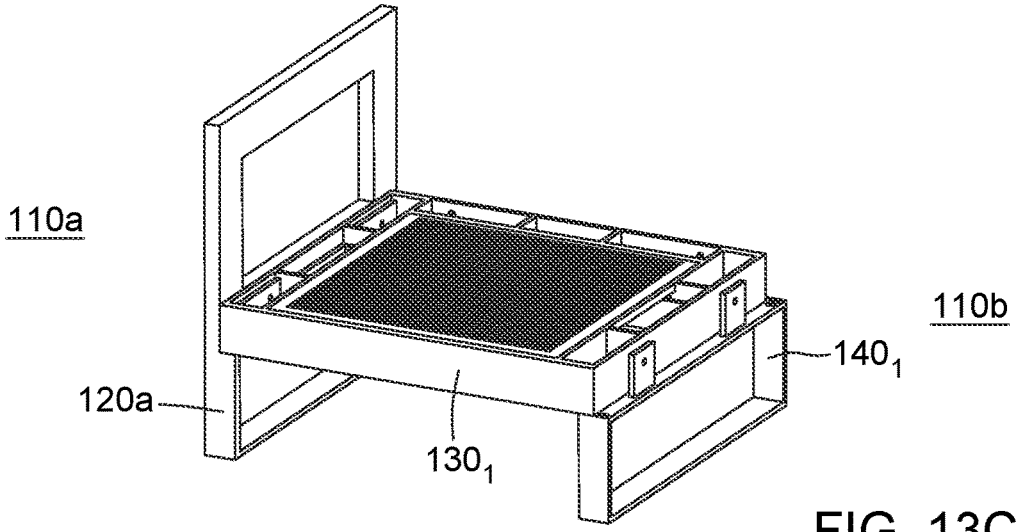
Figure 14A:
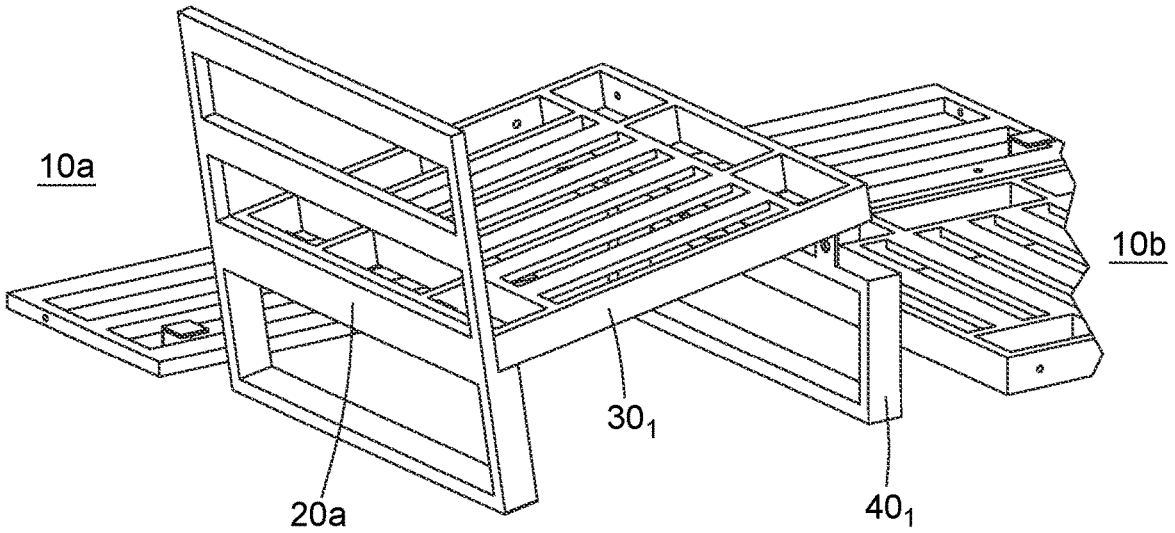
FIGS. 14A to 14H are perspective views of the modular seating assembly shown in FIG. 1A being assembled into a corner sofa seating arrangement.
Figure 14B:
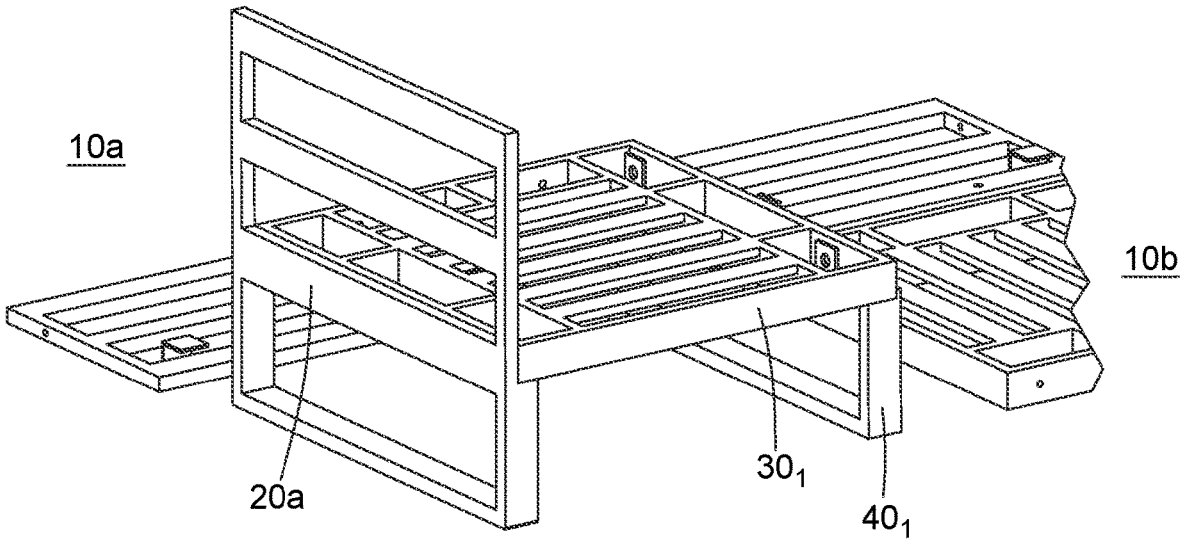

With specific reference to FIGS. 12A, 12B, 13A to 13C, 14A and 14B, once the desired seating arrangement has been laid out, the assembler can removably or reversibly couple a first seat module $\mathbf{30}_1$, $\mathbf{130}_1$ to the first end module 20*a*, 120*a* and a first leg module $\mathbf{40}_1$, $\mathbf{140}_1$. The first seat module $\mathbf{30}_1$, $\mathbf{130}_1$ is coupled to the first end module 20*a*, 120*a* by inserting the flanges 24, 124 on a first end module 20*a*, 120*a* into the openings $\mathbf{34}_1$, $\mathbf{34}_2$, 134 on the first side 10*a*, 110*a* of the first seat module $\mathbf{30}_1$, $\mathbf{130}_1$. The first seat module $\mathbf{30}_1$, $\mathbf{130}_1$ is coupled to the first leg module $\mathbf{140}_1$ by inserted the flanges 44, 144 on the first leg module $\mathbf{40}_1$, $\mathbf{140}_1$ into the openings $\mathbf{34}_3$, $\mathbf{34}_4$, 134 on the second side 10*b*, 110*b* of the first seat module $\mathbf{30}_1$, $\mathbf{130}_1$. Once the first seat module $\mathbf{30}_1$, $\mathbf{130}_1$ is coupled to both the first end module 20*a*, 120*a* and the first leg module $\mathbf{40}_1$, $\mathbf{140}_1$, a self-supporting or free-standing first seat with legs is formed (as shown in FIGS. 12B, 13C, and 14B). This allows the assembler to continue to assemble the modular seating assembly without having to flip or turn the seating portion to access a bottom side thereof.

With specific reference to FIGS. 12C and 13D to 13F, for a sofa or loveseat seating arrangement, a second seat module $\mathbf{30}_2$, $\mathbf{130}_2$ can then be removably or reversibly coupled to the first leg module $\mathbf{40}_1$, $\mathbf{140}_1$, such that the outer walls 34*a*, 134*a* of the openings 34, 134 on the second side 10*b*, 110*b* of the first seat module $\mathbf{30}_1$, $\mathbf{130}_1$ are directly abutting the outer walls 34*a*, 134*a* of the openings 34, 134 on the first side 10*a*, 110*a* of the second seat module $\mathbf{30}_2$, $\mathbf{130}_2$.

Figure 12C:
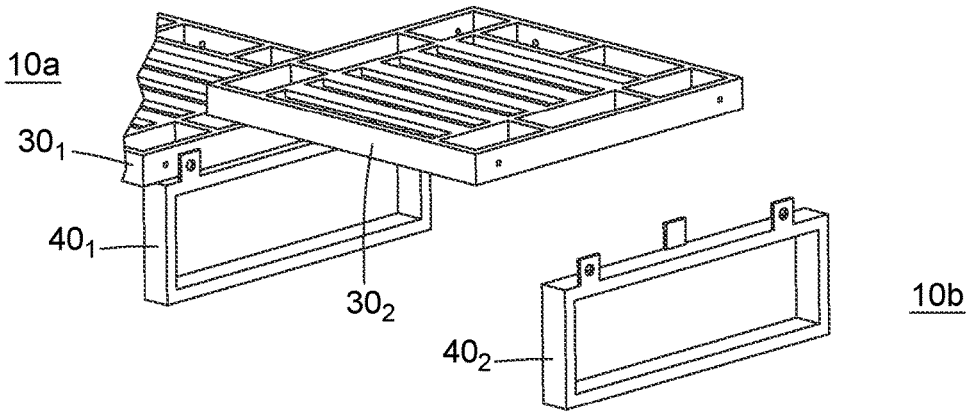
Figure 12D:
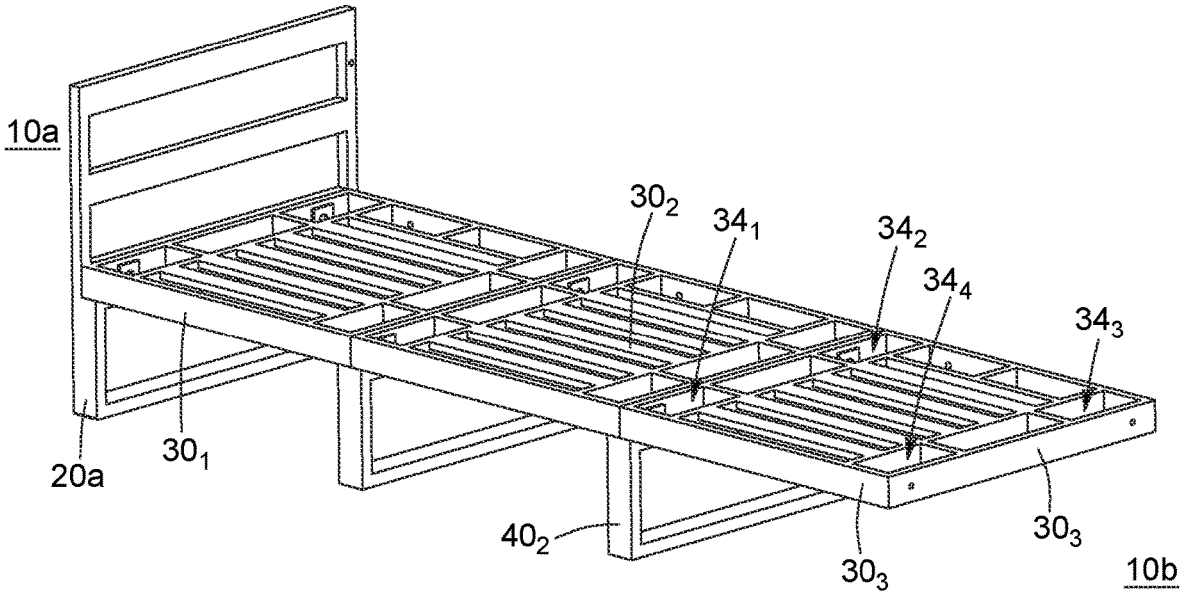
Figure 12E:
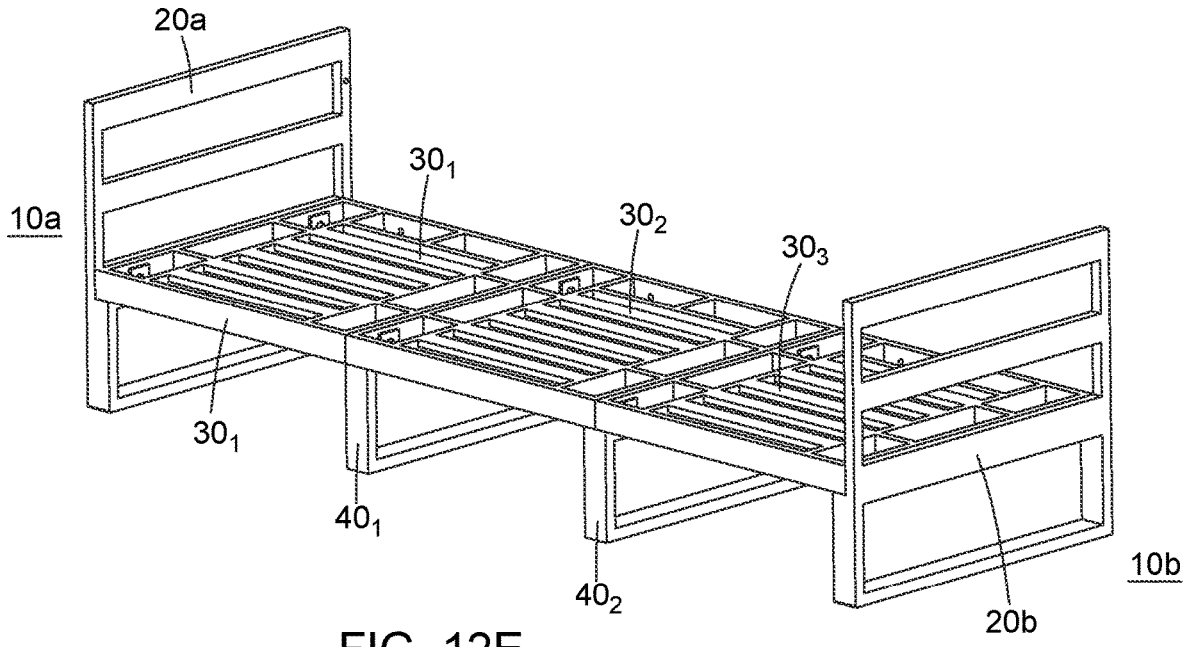
Figure 13D:
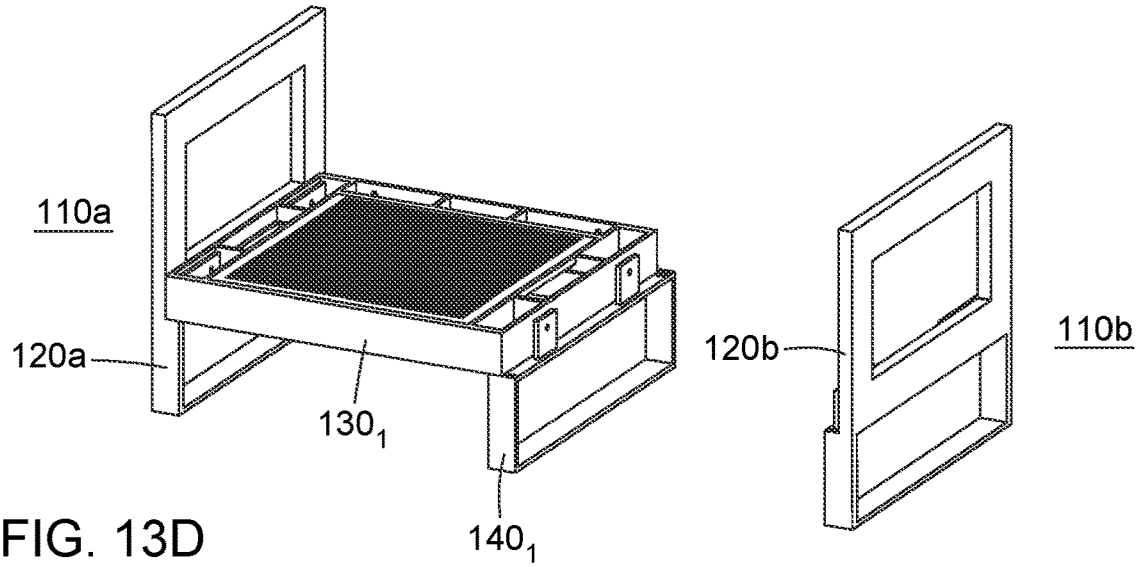
Figure 13E:
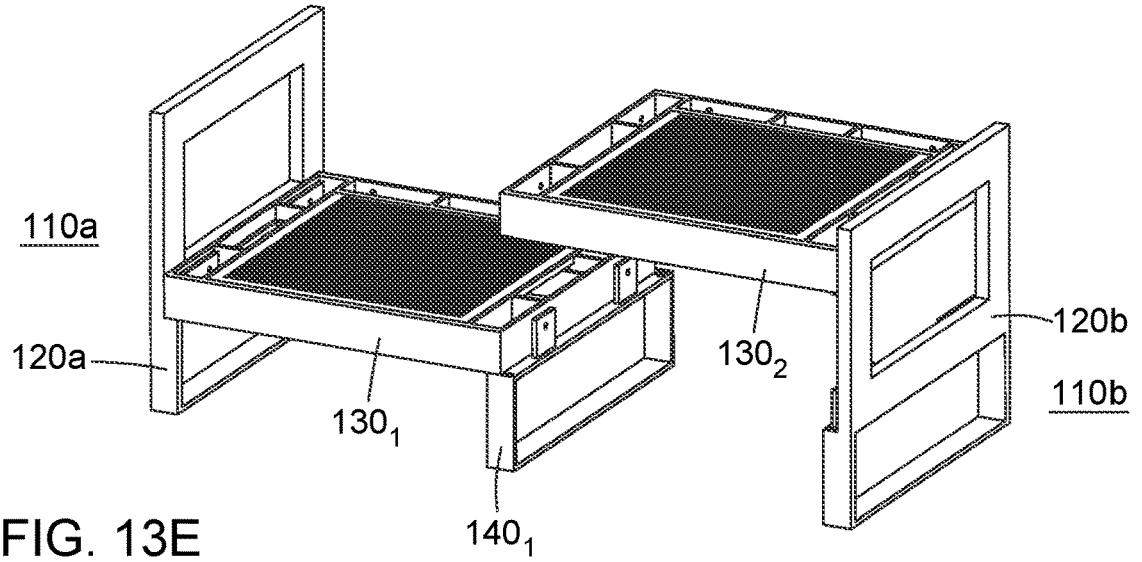
Figure 13F:
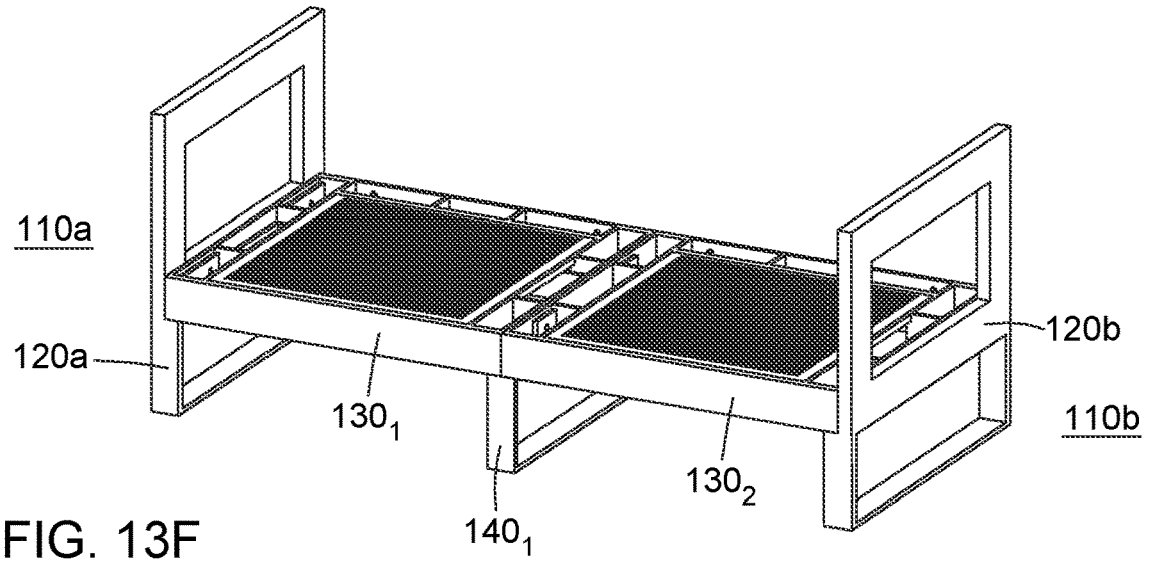

When the seating arrangement is a sofa having three seat modules 40 (as shown in FIG. 12E), similar to the first seat module $\mathbf{30}_1$, the second seat module $\mathbf{30}_2$ can be removably or reversibly coupled to a second leg module $\mathbf{40}_2$ via the openings $\mathbf{34}_3$, $\mathbf{34}_4$ on the second side 10*b* of the second seat module $\mathbf{30}_2$, as shown in FIG. 12C. When the seating arrangement is a loveseat having two seat modules 140 (as shown in FIG. 13F, the second side 110*b* of the seat module $\mathbf{140}_2$ can be removably coupled to the second end module 120*b* by inserting the flanges 124 on the second end module 120*b* into the openings 134 on the second side 110*b* of the second end module 120*b*, as shown in FIGS. 13D to 13F.

Figure 14C:
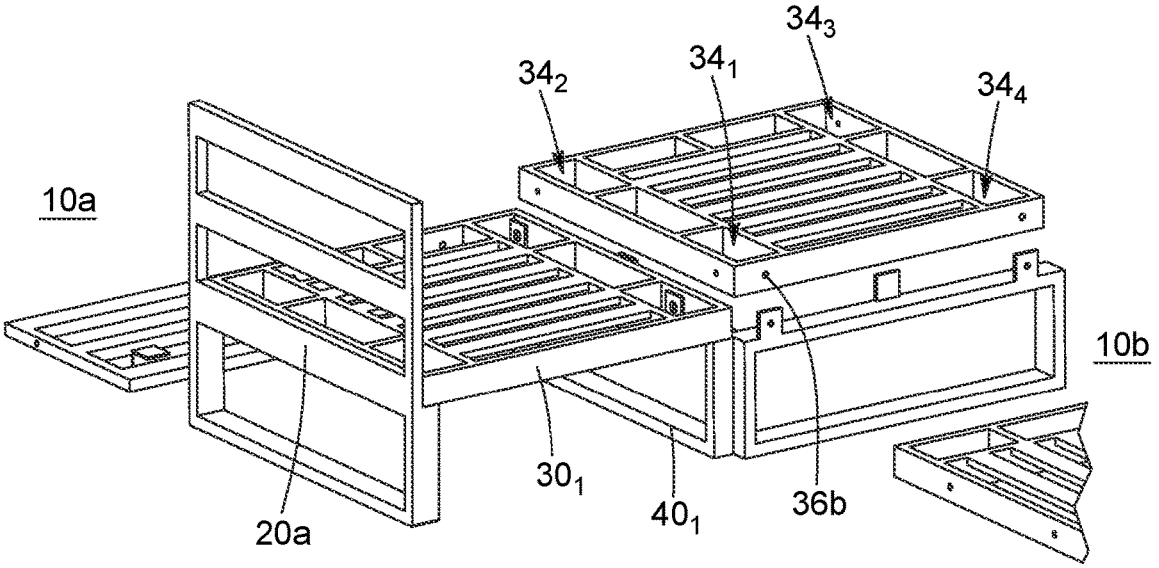
Figure 14D:
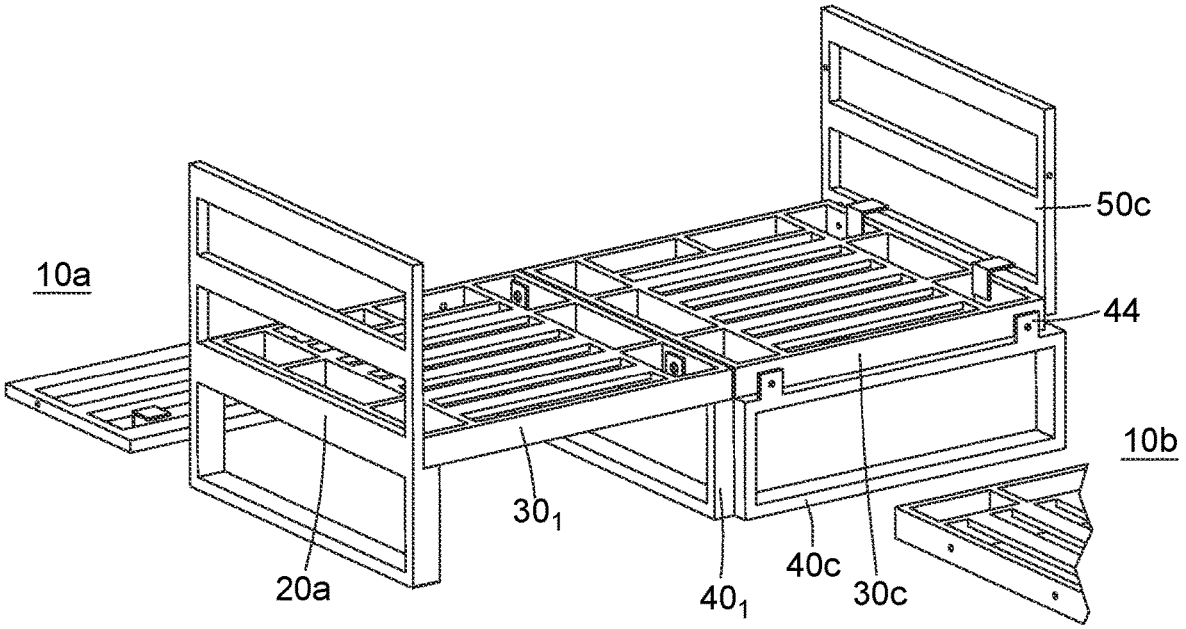
Figure 14E:
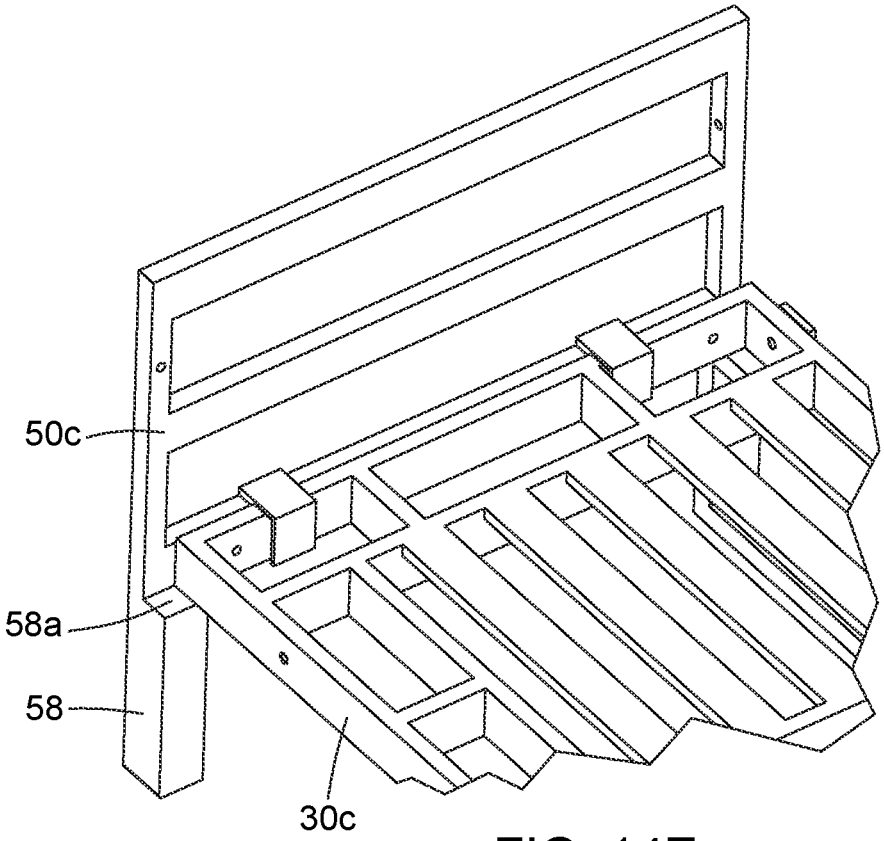

With specific reference to FIGS. 14C to 14E, when the modular seating assembly 10 is being assembled in a corner sofa seating arrangement, the second seat module can be a corner seat module 30*c* or a seat module, such as the second seat module $\mathbf{30}_2$ (shown in FIG. 12D). The corner seat module 30*c* differs from the second seat module $\mathbf{30}_2$ in that it includes a second set of holes 36*b* in the outer walls 34*a* of the openings 34 on the front side of the corner seat module 30*c* that are configured to align with the flanges 44 on a corner leg module 40*c* or a second leg module $\mathbf{40}_2$ (such as shown in FIG. 12D). To assemble the corner sofa seating arrangement, the flanges 44 on the first leg module $\mathbf{40}_1$ are inserted into the openings $\mathbf{34}_1$, $\mathbf{34}_2$ on the first side 10*a* of the corner seat module 30*c*. In the exemplary embodiment, the flanges 44 on a corner leg module 40*c* are then inserted into the openings $\mathbf{34}_1$, $\mathbf{34}_4$ on the front side of the corner seat module 30*c*. In some embodiments, the corner leg module 40*c* can have a slightly smaller depth or length LL than the leg modules 40, such that the corner leg module 40*c* does not interfere with the adjacent leg module $\mathbf{40}_1$.

In some embodiments, a corner backrest module 50*c*, which is a backrest module 50 that includes a leg support 58, can be coupled to a second side 10*b* of the corner seat module 30*c* by inserting the brackets 54 into the openings $\mathbf{34}_3$, $\mathbf{34}_4$, as shown in FIGS. 14D and 14E. In some embodiments, the brackets 54 can be inserted into the openings $\mathbf{34}_3$, $\mathbf{34}_4$ in a nonaligned manner and the assembler can slide the corner seat module 30*c* into position to rest on the top surface 58*a* of the leg support 58. In some embodiments, the top surface 58*a* can include an alignment mechanism, such as a groove, indentation, etc. that is configured to align and engage with a corresponding alignment mechanism, such as a rail, protrusion, etc. on a bottom side of the outer wall 34*a* of the corner seat module 30*c*, or vice versa.

Figure 14F:
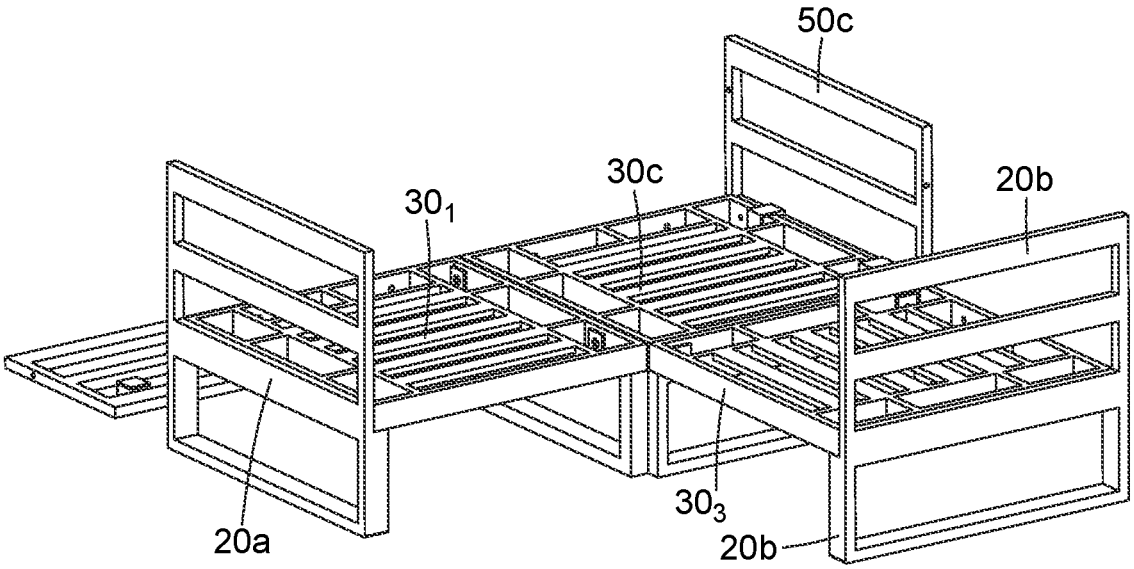
Figure 14G:
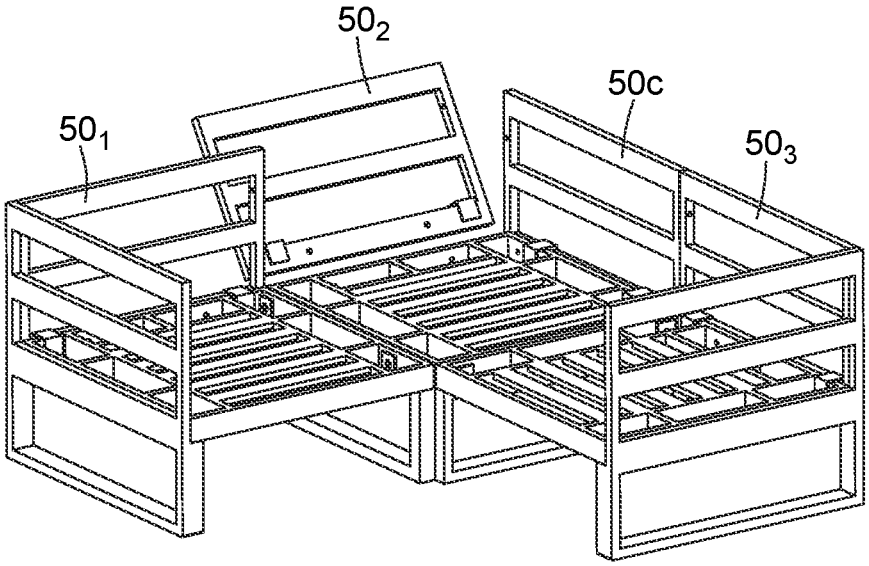

In this embodiment, the third seat module $\mathbf{30}_3$ can be added to the seating arrangement by inserting the flanges 44 on the corner leg module 40*c* into the openings $\mathbf{34}_1$, $\mathbf{34}_2$ on the third seat module $\mathbf{30}_3$ and inserting the flanges 24 on the second end module 20*b* into the openings $\mathbf{34}_3$, $\mathbf{34}_4$ on the second side 10*b* of the third seat module $\mathbf{30}_3$, as shown in FIG. 14F.

With specific reference to FIGS. 12D and 12E, for a sofa seating arrangement, a third seat module $\mathbf{30}_3$ can be removably coupled to the second side 10*b* of the second leg module $\mathbf{40}_2$ by inserting the flanges 44 into the openings $\mathbf{34}_3$, $\mathbf{34}_4$ on the first side 10*a* of the third seat module $\mathbf{30}_3$, as shown in FIG. 12D. Once the third seat module $\mathbf{30}_3$ has been coupled to the second leg module $\mathbf{40}_2$, the outer walls 34*a* of the openings 34 on the first side 10*a* of the third seat module $\mathbf{30}_3$ are directly abutting the outer walls 34*a* of the openings 34 on the second side 10*b* of the second seat module $\mathbf{30}_2$. Similar to the first seat module $\mathbf{30}_1$, the third seat module $\mathbf{30}_3$ can be removably or reversibly coupled to the second end module 20*b* by inserting the flanges 44 on the second end module 20*b* into the openings $\mathbf{34}_3$, $\mathbf{34}_4$ on the second side 10*b* of the third seat module $\mathbf{30}_3$, as shown in FIG. 12E.

Figure 12F:
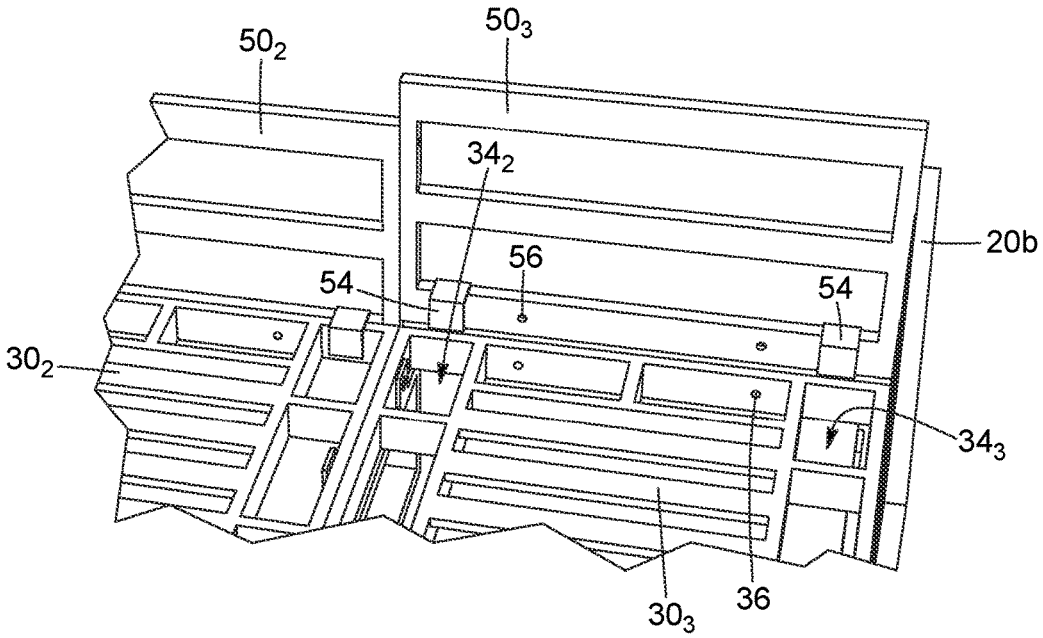
Figure 13G:
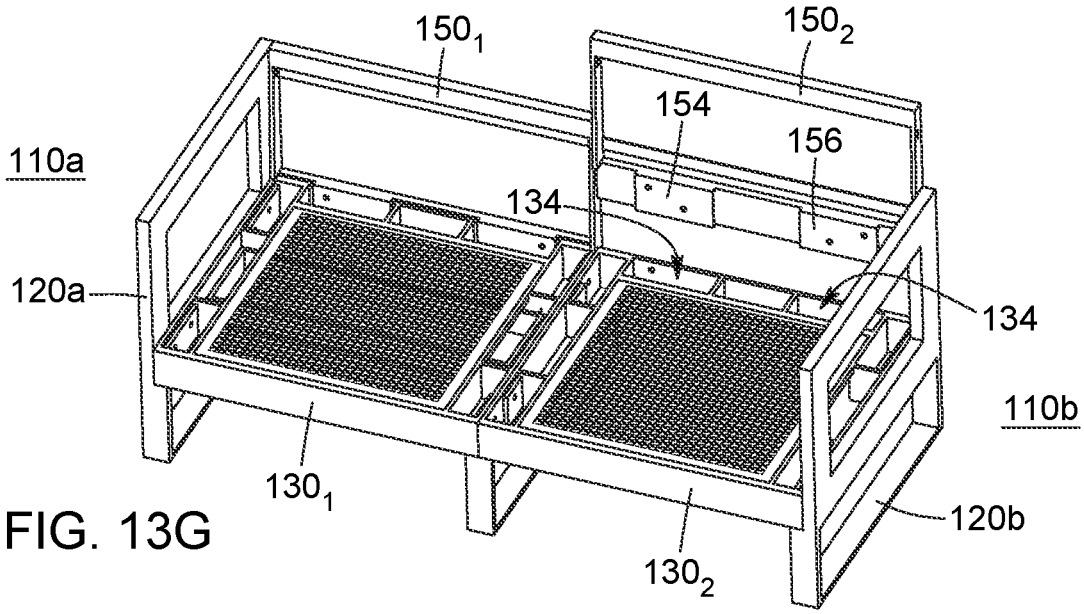
Figure 13H:
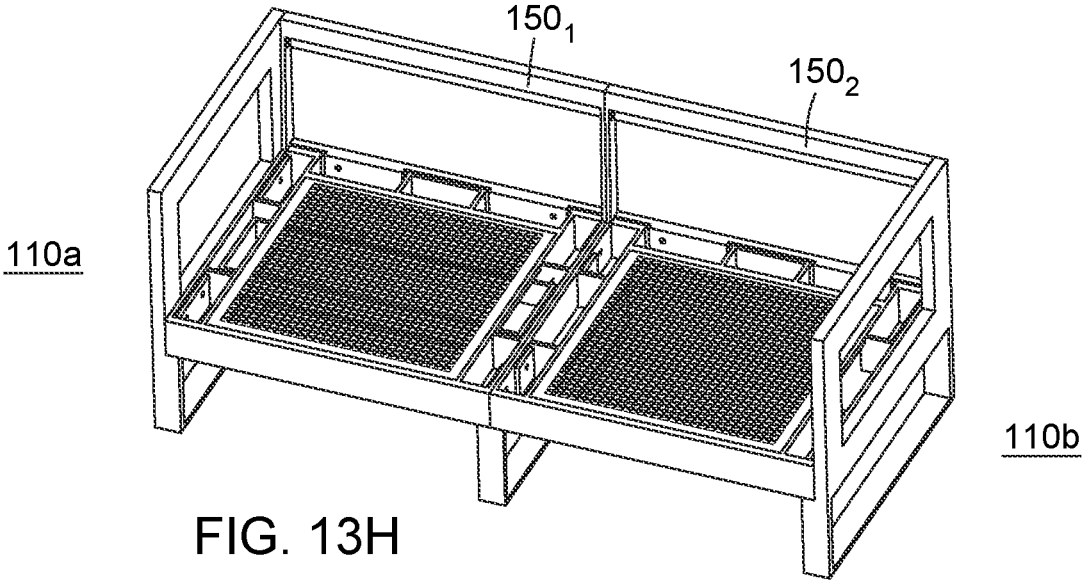
Figure 13I:
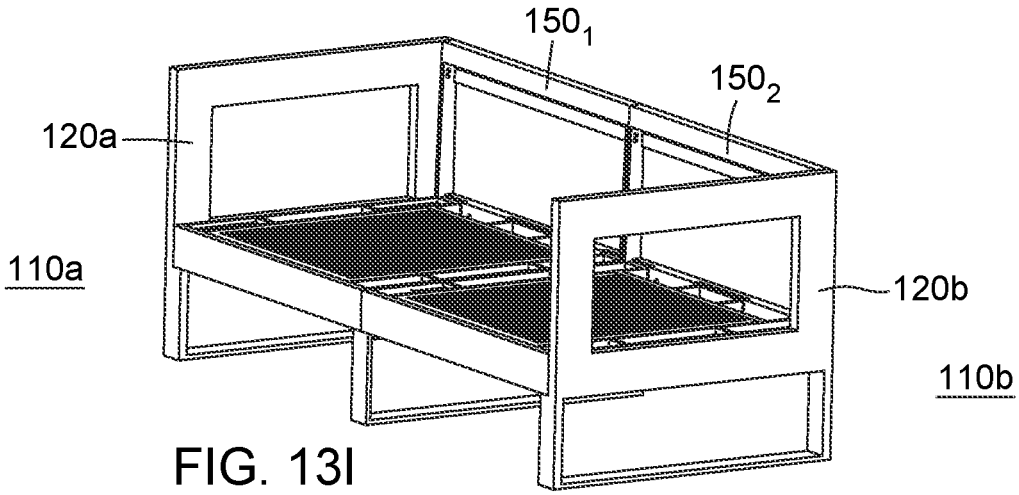

With specific reference to FIGS. 12F, 13G to 13I, and 14G, the backrest modules 50, 150 can be removably coupled to a backside of each of the seat modules $\mathbf{30}_{1\text{-}3}$, $\mathbf{130}_{1\text{-}2}$ by inserting the downwardly extending flange on the brackets 54, 154 into the openings $\mathbf{34}_2$, $\mathbf{34}_3$, 134 on a back side of the respective seat module $\mathbf{30}_{1\text{-}3}$, $\mathbf{130}_{1\text{-}2}$. In some embodiments, such as shown in FIG. 12F, once the bracket 54 is inserted in the openings $\mathbf{34}_2$, $\mathbf{34}_3$, holes 56 in a front side of the backrest module 50 align with holes 36 in a back side of the seat module 30. In other embodiments, such as shown in FIG. 13G, once the bracket 154 is inserted in the openings 134, holes 156 in a front side of the brackets 154 align with holes 136 in a back side of the seat module 130.

As is understood by the skilled artisan, once the respective flanges 24, 124, 44, 144 and, when the seating arrangement includes a backrest module 50, 150, brackets 54, 154, are inserted into their corresponding openings $\mathbf{34}_{1\text{-}4}$, 134, the frame of the modular seating assembly 10, 110 is assembled and freestanding or self-supporting without fasteners 16. In some embodiments, the cushions 14, 114 can be placed on the seat modules 30, 130 and/or the backrest modules 50, 150, thus completing the assembly of the seating arrangement.

Figure 12G:
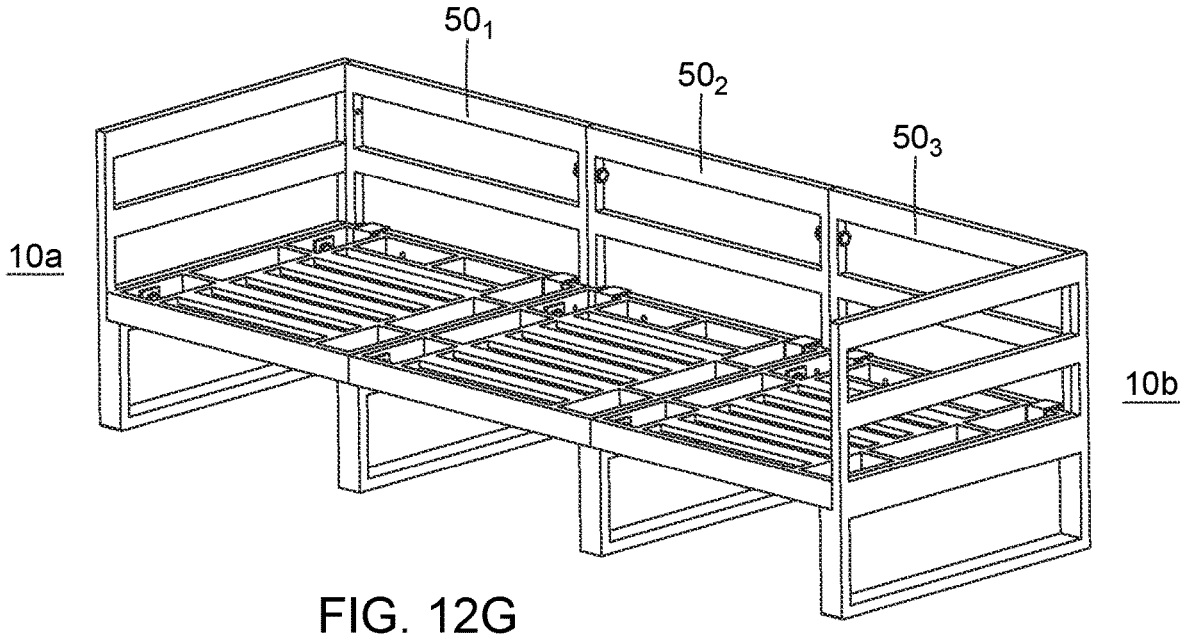
Figure 12H:
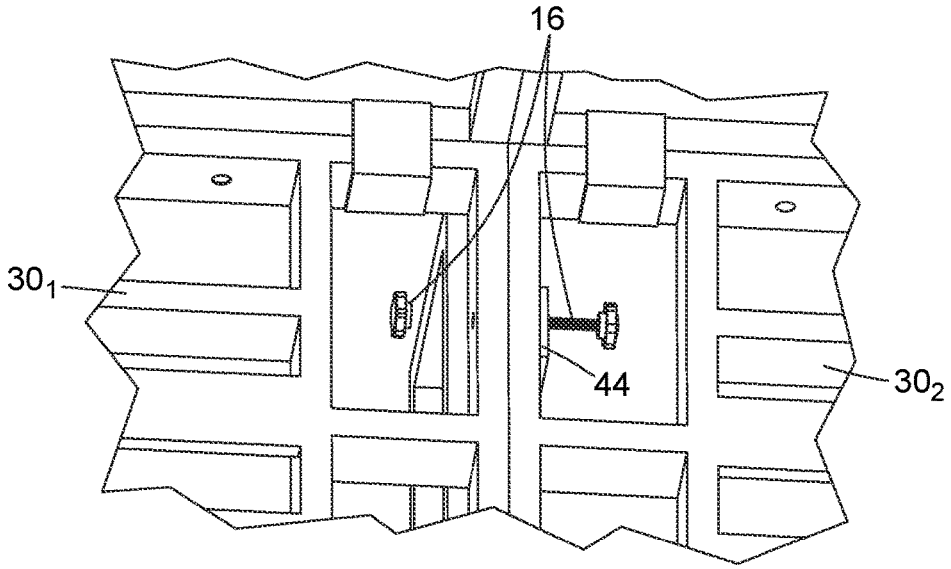
Figure 12I:
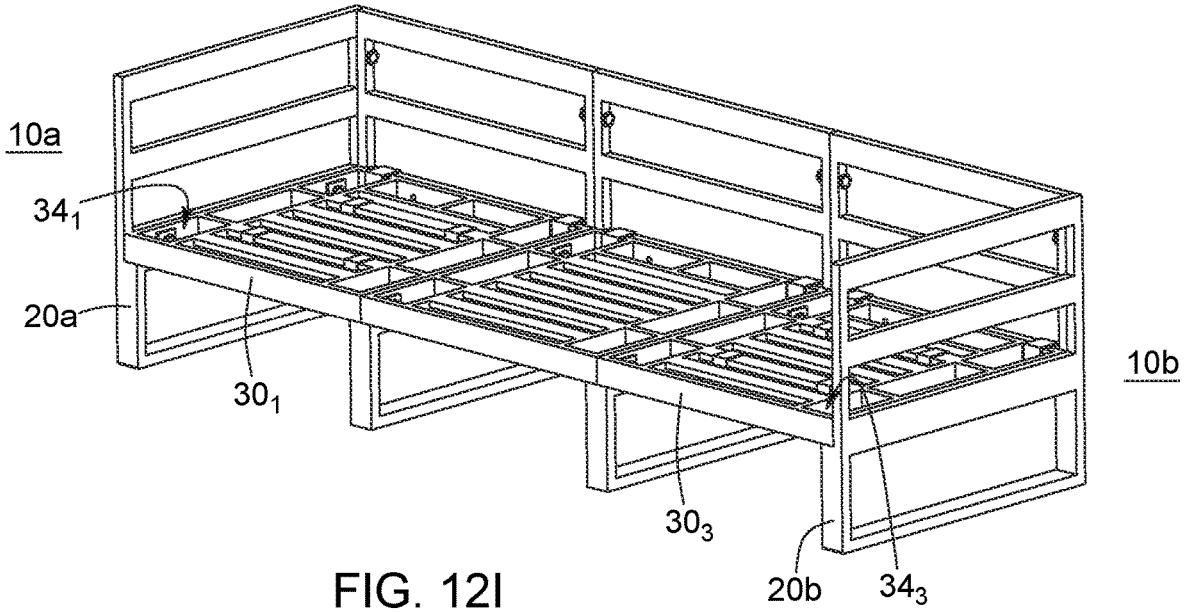

In other embodiments, such as shown in FIGS. 12G to 12I, the frame can be reinforced with fasteners 16. In some embodiments, the fasteners 16 are configured to couple a respective flange 24, 124, 44, 144 with a corresponding opening $\mathbf{34}_{1\text{-}6}$, 134, such as shown in FIGS. 12H and 12I. Additionally, or alternatively, adjacent modules of the modular seating arrangement 10, 110 can be coupled to each other. For example, as shown in FIG. 12G, a second backrest module 502 can be coupled to a first backrest module $\mathbf{50}_1$ on the first side 10*a* and to a third backrest module 503 on the second side 10*b*. Similarly, as shown in FIG. 12H, adjacent seat modules (such as first seat module $\mathbf{30}_1$ and the second seat module $\mathbf{30}_2$) are coupled to each other and to an adjacent leg module, in this case the first leg module $\mathbf{40}_1$, via a fastener 16. The fastener 16 extends through an aperture in the flange 44 in the leg module $\mathbf{40}_1$, through the hole 36 on the first side 10*a* of the second seat module $\mathbf{30}_2$, and through the hole 36 on the second side 10*b* of the first seat module $\mathbf{30}_1$, thus coupling the first leg module $\mathbf{40}_1$ to respective openings in the first and second seat modules $\mathbf{30}_1$, $\mathbf{30}_2$ and coupling the first and second seat modules $\mathbf{30}_1$, $\mathbf{30}_2$ to each other. As shown in FIG. 12I, in some embodiments, the end modules 20*a*, 20*b* can be coupled to the outer side seat modules. In the exemplary sofa seating arrangement embodiment, the end modules 20*a*, 20*b* are coupled to the first and third seat modules $\mathbf{30}_1$, $\mathbf{30}_3$, respectively, by inserting fasteners 16 through holes 36 in the openings $\mathbf{34}_1$, $\mathbf{34}_4$ in the first and third seat modules $\mathbf{30}_1$, $\mathbf{30}_3$, respectively, and through holes 26 in the flanges 24 on the end modules 20*a*, 20*b*.

As is best shown in FIG. 12H, in the exemplary embodiment, the openings $\mathbf{34}_{1\text{-}4}$, 134 are configured to be of a size that can receive the flanges 44, 144 and/or brackets 54, 154 on the leg module 40, as well as providing enough space for the assembler to insert the fastener 16. In other embodiments, the openings 34, 134 can be a slot or aperture that is configured to receive a respective flange 44, 144, brackets 54, 154 or other attachment means on the adjacent module, such as a protrusion, via a clearance fit or an interference fit. By securing adjacent modules via flanges 24, 124, 44, 144 or brackets 54, 154 in an opening 34, 134 in adjacent seat modules 30, 130, the modular seating assembly 10, 110 can be completely assembled without the use of fasteners.

Figure 12J:
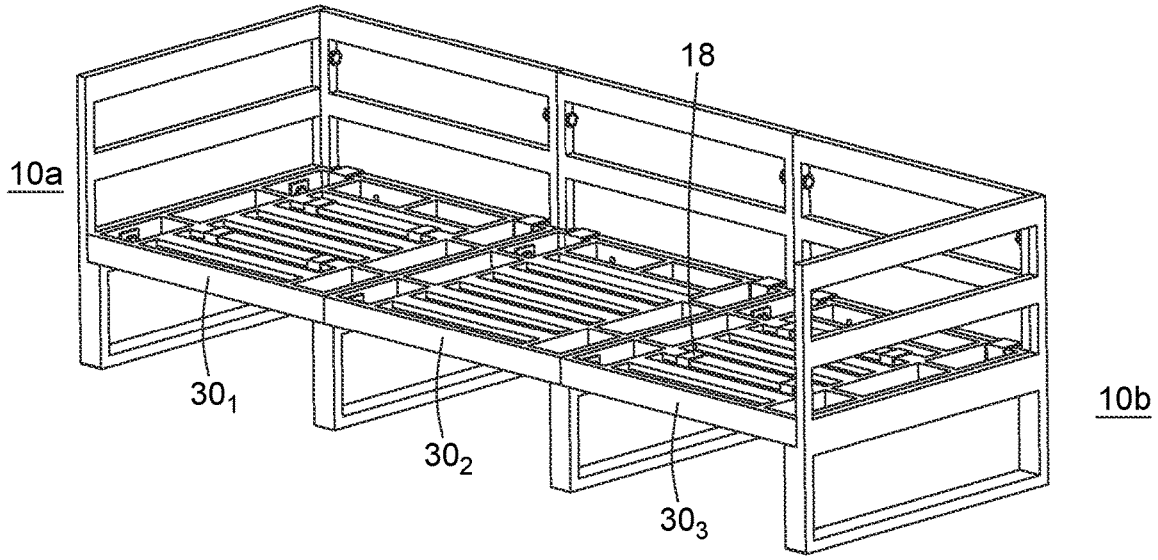
Figure 14H:
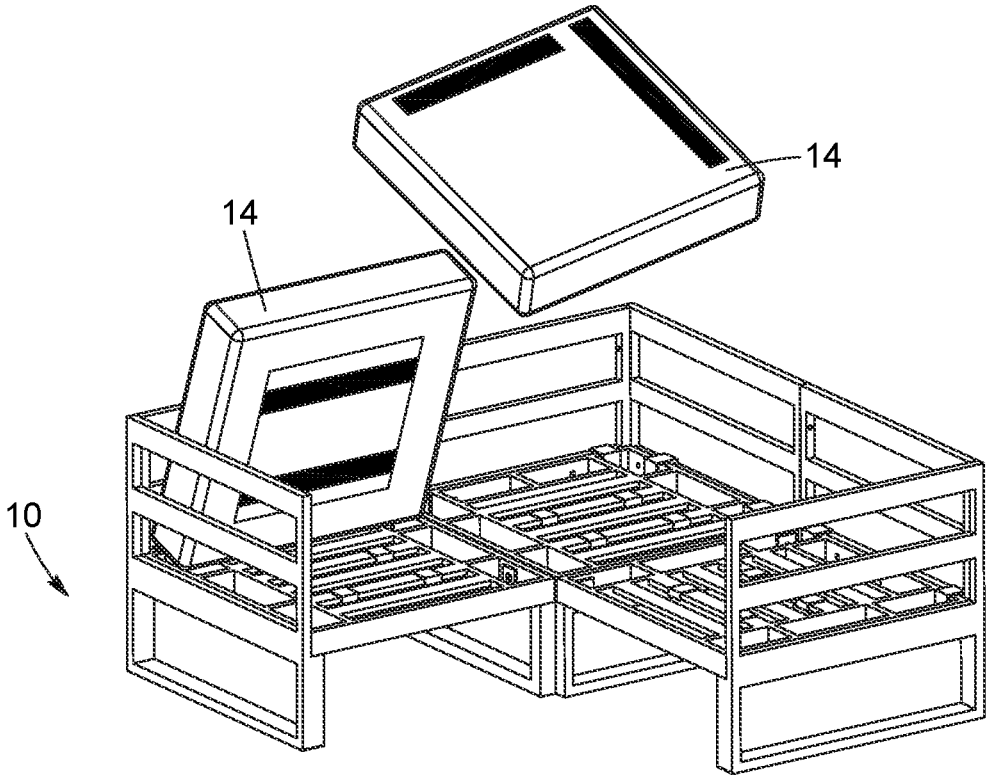
Figure 15A:
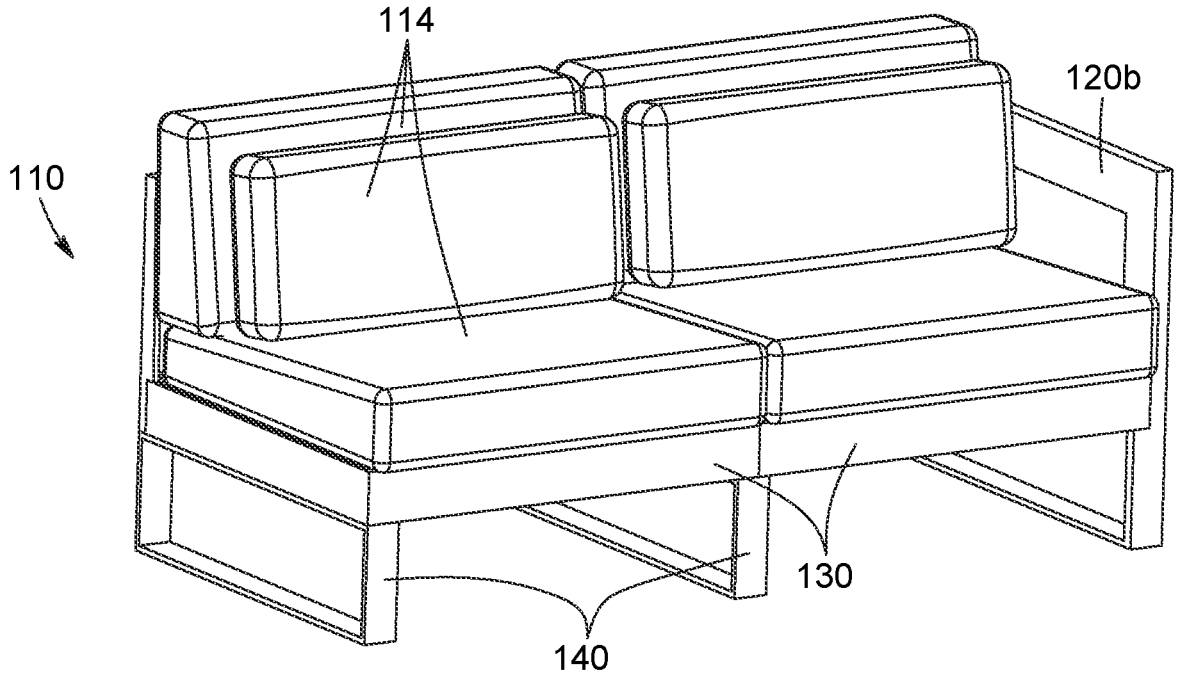
FIG. 15A is a perspective front view of the modular seating assembly shown in FIG. 8A in an assembled configuration as an end sofa seating arrangement.
Figure 15B:
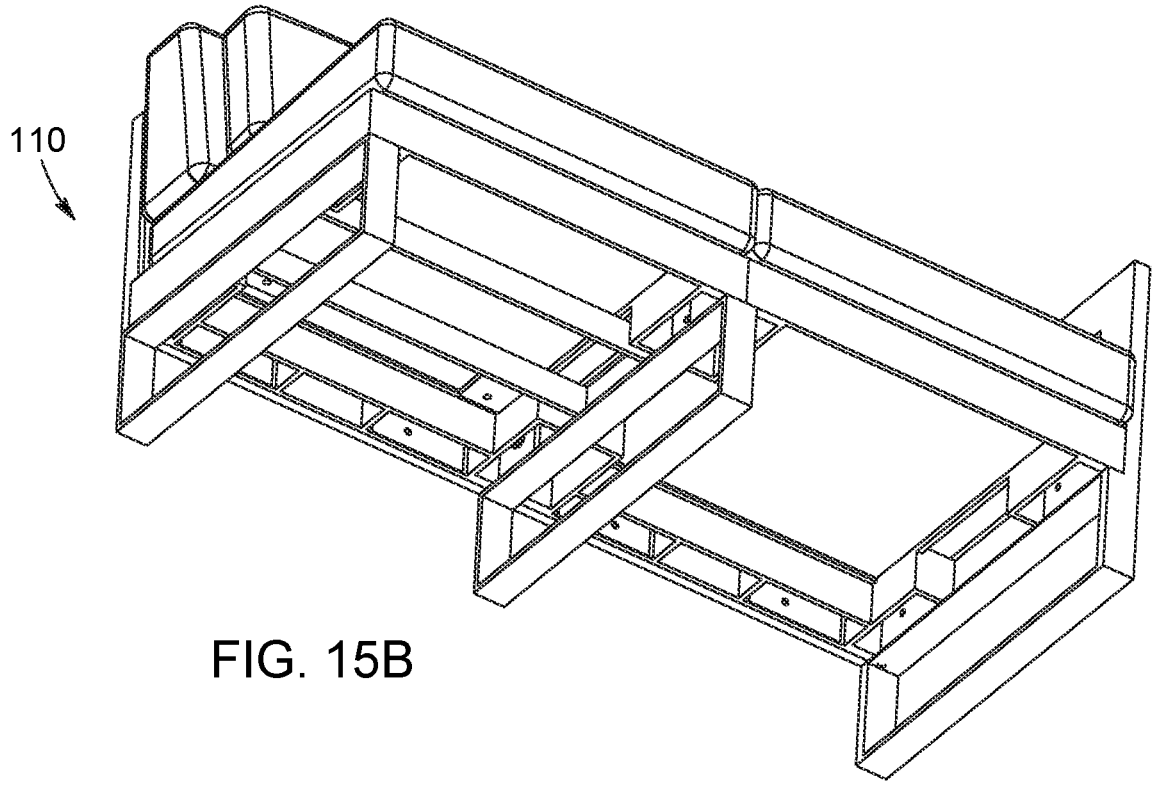
FIG. 15B is a perspective bottom view of the end sofa seating arrangement shown in FIG. 15A in an assembled configuration.
Figure 15C:
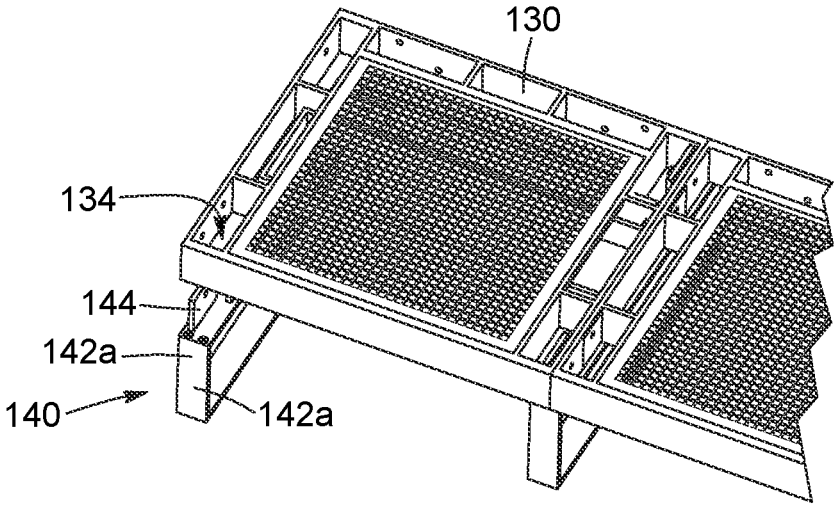
FIGS. 15C to 15E are perspective top views of the modular seating assembly shown in FIG. 8A being assembled into the end sofa seating arrangement shown in FIG. 15A.
Figure 15D:
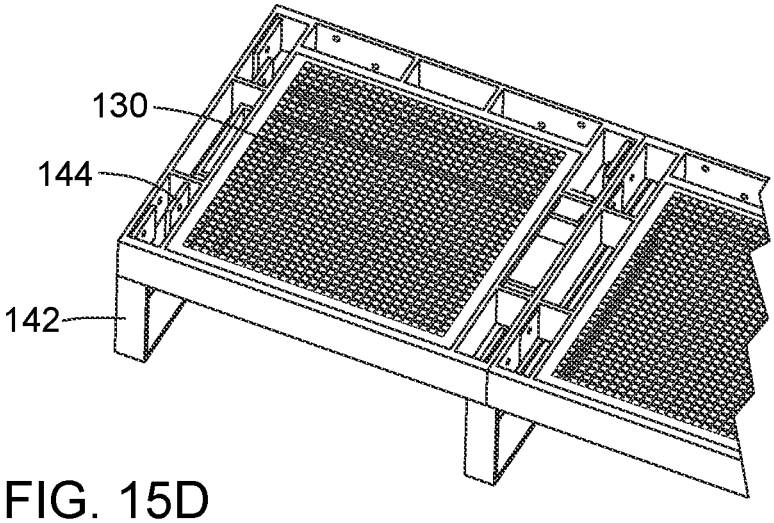
Figure 15E:
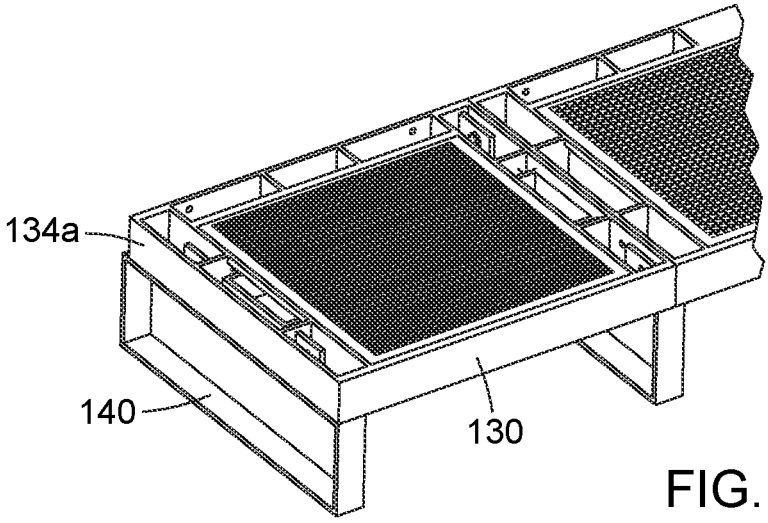
Figure 16A:
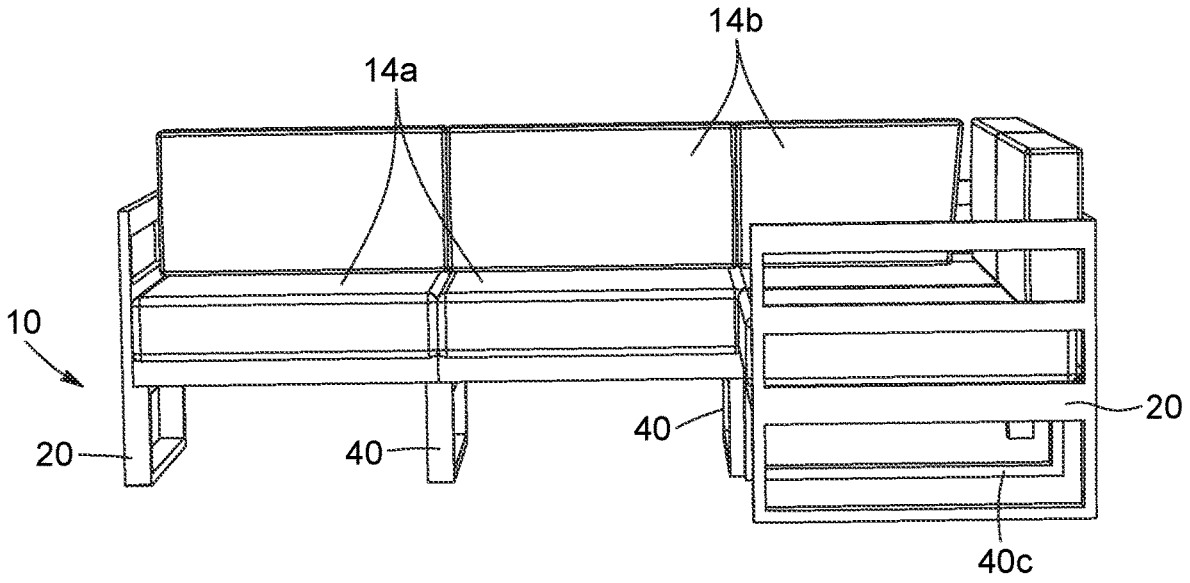
FIG. 16A is a perspective front view of the modular seating assembly shown in FIG. 1A in an assembled configuration as a corner sofa seating arrangement having three seat modules and a corner seat module.
Figure 16B:
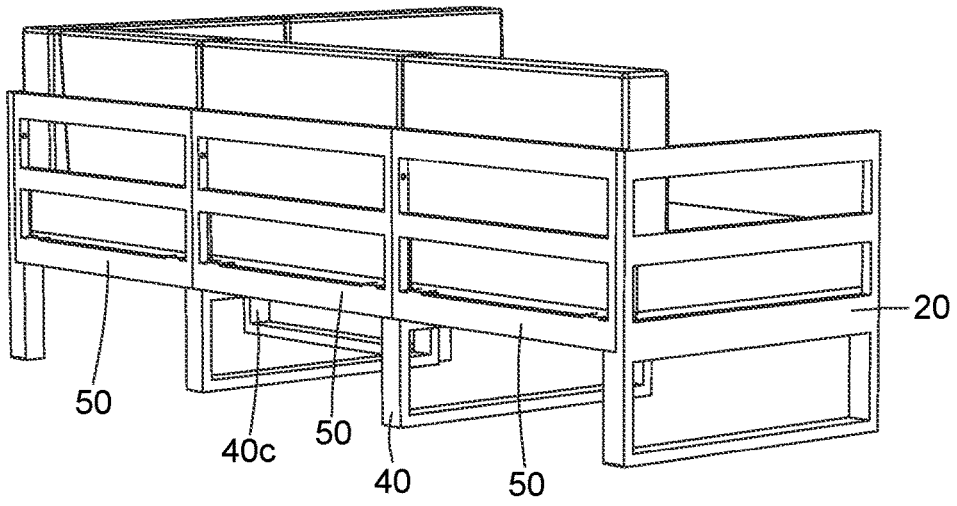
FIG. 16B is a perspective back view of the corner sofa seating arrangement shown in FIG. 16A.
Figure 16C:
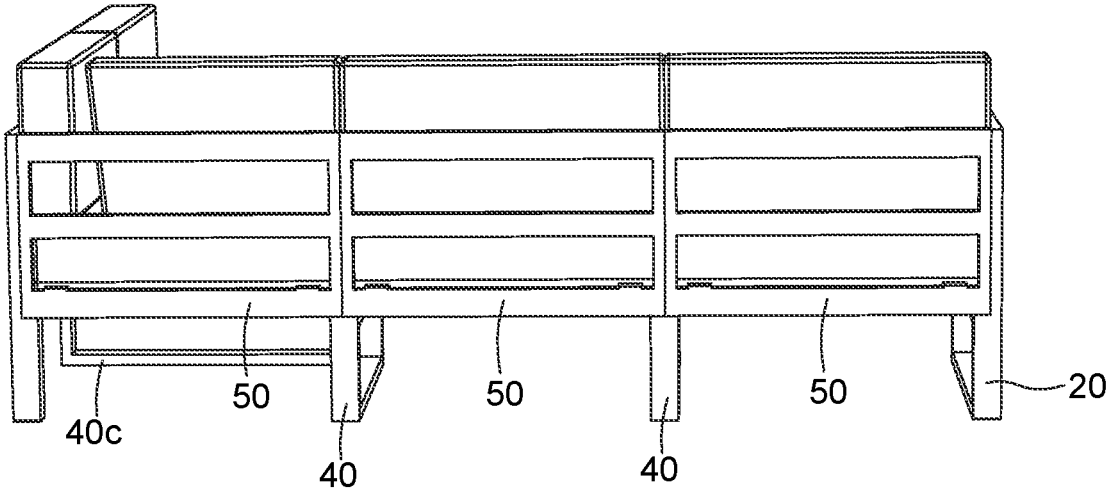
FIG. 16C is a perspective back view of the corner sofa seating arrangement shown in FIG. 16A.
Figure 16D:
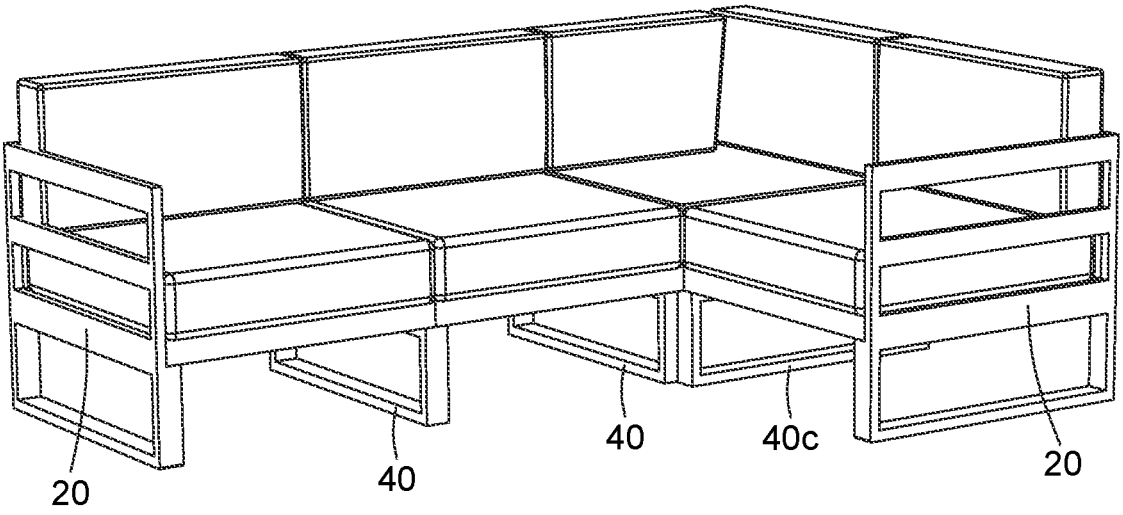
FIG. 16D is a perspective front view of the corner sofa seating arrangement shown in FIG. 16A.
Figure 16E:
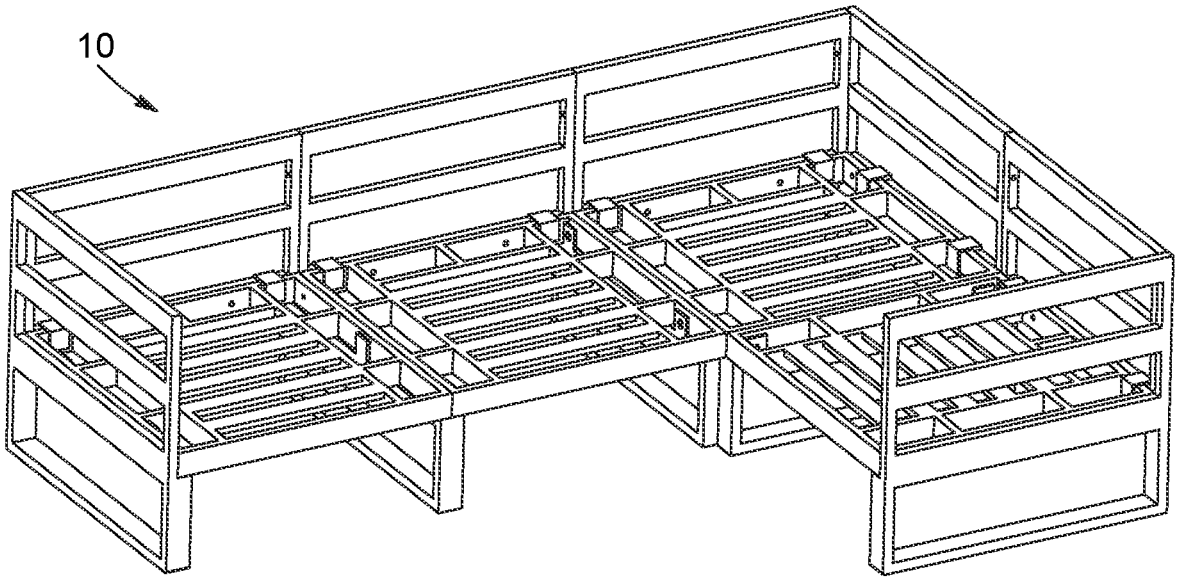
FIG. 16E is a perspective front view of the frame of the corner sofa seating arrangement shown in FIG. 16A.
Figure 16F:
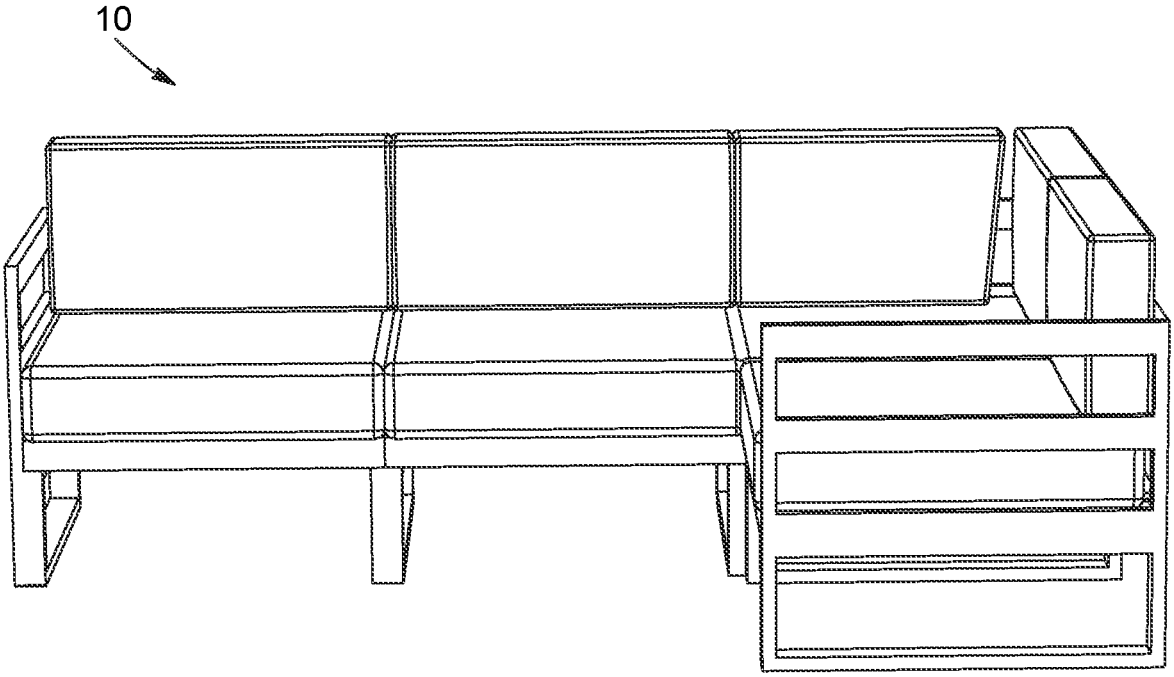
FIG. 16F is a perspective front view of the corner sofa seating arrangement shown in FIG. 16A with measurements.

With specific reference to FIG. 12J, in some embodiments, the cushions 14, 114 or other padding can be removably coupled to the seat modules 30, 130 and/or the backrest modules 50, 150 by coupling a fastening means 18 to a top surface of the seat modules 30, 130 or the front surface of the backrest modules 50, 150. The fastening means 18 is configured to engage with and couple to an underside or a backside to the cushion 14, 114 such as shown in FIG. 14H.

Referring now to FIGS. 15A to 15E, in some embodiments, the modular seating assembly 110 can have a seating arrangement that is an end sofa. The end sofa is a sofa with only one arm, for example so that the non-arm side of the sofa can be placed against a wall. In this embodiment, one of the end modules 120 is replaced with a leg module 140 that supports one seat module 130, as opposed to two seat modules 130. In this seating arrangement embodiment, all of the flanges 144 on the top surface 142*a* of the leg portion 142 are inserted into the openings 134, such that an inner side of the outer wall 134*a* and an inner side of the inner wall 134*b* of the opening 134 each abut an outside surface of one of the opposing flanges 144. As such, a first side 110*a* surface of the outside surface of the leg module 140 is flush or aligned with a first side 110*a* outside surface of the seat module 130.

Seating Arrangements

As described above, any number of seat modules 30 can be used with the modular seating assembly 10, to create the desired seating arrangement. For example, as detailed herein, the plurality of modules can be arranged to form an ottoman or a chair, both of which would include a single seat module 30. Alternatively, the modular seating assembly 10 can be arranged as a loveseat that includes two seat modules 30, a sofa or couch that includes three, four, or more seat modules 30, depending on the desired length, or a corner sofa, which similarly can include three, four, five, or more seat modules 30 depending on the desired size.

For example, the modular seating assembly 10 can include only the leg portion of the end modules, seat modules, and leg modules, such that the modular seating assembly 10 is assembled in a daybed or bench seating arrangement. Alternatively, the modular seating assembly 10 can include only the two end modules and a single seat module, such that the modular seating assembly 10 is configured as a chair, or can include only the leg portions of the end modules or leg modules and a single seat module, such that the modular seating assembly 10 is configured as an ottoman or a chair without arm rests.

Other configurations are also contemplated, such as a sectional couch with two or three corner seat modules 50*c*, 150*c*, for example a wrap around couch, or four corner seat modules 50*c*, 150*c* to define an enclosed space, such as a playpen.

Referring now to FIGS. 16A to 16F, a modular seating assembly 10 assembled in a corner sofa seating arrangement is shown. The modular seating assembly 10 includes two end modules 20, three seat modules 30, one corner seat module 30*c*, two leg modules 40, one corner leg module 40*c*, four backrest modules 50, one corner backrest module 50*c*, four seat cushions 14*a*, and five backrest cushions 14*b*.

In some embodiments, the modular seating assembly 10, 110 can be configured for outdoor use, such as patio furniture. In some embodiment, one or more of the modules (i.e., the end modules, the seat module, the backrest modules, and/or the leg modules) can comprise a waterproof or water-resistant material. For example, one or more of the modules can comprise metal, such as aluminum, wrought iron, stainless steel, cast iron, cast aluminum, etc.; plastic, such as polyethylene (PE), including high-density PE (HDPE), polypropylene (PP), polyvinyl chloride (PVC), etc. or other materials, such as wicker or teak. In some embodiments, each of the modules comprise aluminum or cast aluminum. In some embodiments, one or more of the modules (or any portion thereof, such as the frame, the seating portion, the armrest portion, the cushions and/or padding), can include perforations to allow moisture to drain therefrom.

Consideration to the environment the furniture is intended for should be given when choosing the material and/or configuration of the perforations. For example, when the assembled seating arrangements are configured for outdoor use, such as patio furniture, one or more of the modules can be hollow or include portions comprising a hollow tubing. Providing hollow modules reduces the overall weight of the modular seating assembly and allows for easier storage when not in use. Similarly, when intended for outdoor use, one or more of the hollow modules can also include at least one perforation in a bottom side thereof to allow moisture, such as rainwater or other liquids, that may have accumulated inside the modules to drain via gravity.

Other Configurations

While seating furniture are described above, it is understood that the features of the modular seating assembly described herein can be applied to other types of modular furniture. For example, a modular furniture assembly can include end modulars flanking one or more platform module to form a table, end table, desk, bed, shelves, etc.

In such embodiments, the end modules can include some or all of the features as described for the end modules 20. Depending on the type of furniture being assembled, the leg portion 22 of the end modules 20 can be adjusted for length and width.

The platform module can include some or all of the features as described for the seat module 30. Depending on the type of furniture being assembled, the platform modules can be adjusted for length and width. In some embodiments, the modular furniture assembly can include a single planar top that is configured to be removably coupled to one or more platform modules, or alternatively, a plurality of planar tops that are removable coupled to each of the platform modules. For example, similar to the cushions 14 being removably coupled to the seat module 30, the planar top, such as a tabletop, can be removably coupled to the platform modules to provide a table of adjustable length. In other embodiments, the platform modules can have a top surface that is a planar surface.

The skilled artisan will understand that these features can be applied to various types of furniture. For example, similar to the corner sofa assembly, a modular furniture assembly can include end modulars flanking three or more platform modules with one of the platform modules being a corner platform module to form a corner desk.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A modular seating assembly comprising:

at least two support modules, each of the support modules comprising a leg portion having an upper surface and a flange originating and extending upwardly from the upper surface of the leg portion; and at least one seat module comprising a seating portion and outer walls at least partially delimiting peripheral openings;

wherein, when in an assembled configuration, a given one of the at least two support modules is configured to support an adjacent one of the at least one seat module, wherein the upper surface of the given one of the at least two support modules abuts a portion of the adjacent one of the at least one seat module, and the flange of the given one of the at least two support modules is inserted into a corresponding one of the peripheral openings in the adjacent one of the at least one seat module; and wherein, when in an assembled configuration, the at least two support modules flank the at least one seat module.

2. The modular seating assembly of claim 1, wherein one of:

the at least two support modules are a first end module and a second end module;

the at least one seat module is at least two seat modules, and the at least two support modules are the first end module, the second end module, and at least one leg module; or the at least one seat module comprises two or more seat modules and a corner seat module and the at least two support modules are the first end module, the second end module, and at least two leg modules.

3. The modular seating assembly of claim 2, wherein the at least one leg module includes opposing flanges extending upwardly from the upper surface on opposite sides of the leg portion.

4. The modular seating assembly of claim 3, wherein the opposing flanges comprise a pair of the opposing flanges, and wherein a first flange in the pair of the opposing flanges is offset or staggered from a second flange in the pair of the opposing flanges.

5. The modular seating assembly of claim 4, wherein a horizontal distance between an outer end of the first flange and an outer end of the second flange along a longitudinal axis of the at least one leg module is equal to or less than a horizontal distance between opposing walls of a respective one of the peripheral openings.

6. The modular seating assembly of claim 2, wherein the at least one leg module is configured to at least partially support two adjacent seat modules.

7. The modular seating assembly of claim 2, wherein the at least one leg module has a length that is equal to or less than a distance between inner surfaces of opposing side walls of an underside of the at least one seat module, and wherein the at least one leg module can be positioned in a storage configuration between the inner surfaces of the opposing side walls on the underside of the at least one seat module via at least one of: an interference fit, fastening means and corresponding attachment mechanisms.

8. The modular seating assembly of claim 2, wherein at least one of the first end module and the second end module further comprises one of:

an arm rest portion extending upwardly from the upper surface of the leg portion on an opposing side from the flange; and a protrusion extending upwardly from the upper surface of the leg portion on the opposing side from the flange.

9. The modular seating assembly of claim 1, further comprising at least one backrest module comprising a backrest portion and at least one bracket extending outwardly and downwardly from the backrest portion, wherein the at least one bracket is configured to be received in a respective one of the peripheral openings on the at least one seat module.

10. The modular seating assembly of claim 9, wherein the at least one backrest module further comprises a leg support having a top surface configured to support a given one of the outer walls of the at least one seat module.

11. The modular seating assembly of claim 1, wherein each of the peripheral openings is sized and shaped to receive a corresponding flange via an interference fit.

12. The modular seating assembly of claim 1, wherein the modular seating assembly is configured for outdoor use.

13. The modular seating assembly of claim 2, wherein the corner seat module is configured to couple on a first side thereof to a respective first one of the two or more seat modules and on a front side thereof to a respective second one of the two or more seat modules.

14. The modular seating assembly of claim 13, further comprising a corner leg module configured to engage the front side of the corner seat module.

15. The modular seating assembly of claim 1, further comprising at least one cushion configured to at least partially cover a seating surface of the at least one seat module.

16. A method of assembling a modular seating assembly as defined in claim 1, the method comprising:

inserting the flange of a first one of the at least two support modules into a corresponding peripheral opening on a first side of a given one of the at least one seat module; and inserting the flange of a second one of the at least two support modules into a corresponding peripheral opening on a second side of the given one of the at least one seat module.

17. The method of claim 16, further comprising:

providing at least one backrest module comprising a backrest portion and a bracket configured to be inserted into a corresponding peripheral opening in the given one of the at least one seat module; and inserting the bracket into the corresponding peripheral opening on a backside of the given one of the at least one seat module.

18. The modular seating assembly of claim 1, wherein each of the at least two support modules comprises a base that supports the corresponding support module in a freestanding condition.

19. The modular seating assembly of claim 1, wherein, when in a partially assembled configuration, the peripheral openings of a given one of the at least one seat module engage respective flanges of one or more adjacent ones of the at least two support modules to form a freestanding seat without fasteners.

20. The modular seating assembly of claim 1, wherein the flange and a corresponding outer wall of the at least one seat module respectively define laterally-extending fastener-receiving apertures that, in the assembled configuration, are mutually aligned to receive at least one fastener extending therethrough to releasably secure the flange to the corresponding outer wall.

* * * * *